United States Patent [19]

Madewell et al.

[11] Patent Number: 4,500,245

[45] Date of Patent: Feb. 19, 1985

[54] MACHINE FOR ACCUMULATING EDGEWISE SUPPORTED ARTICLES

[75] Inventors: James A. Madewell, Terrace Park; Edwin A. Molitor; Norman P. Crowe, both of Miami Township; Guy W. Lampe; Charles F. Pavey, both of Anderson Township, all of Ohio

[73] Assignee: Multifold-International, Inc., Milford, Ohio

[21] Appl. No.: 421,267

[22] Filed: Sep. 22, 1982

[51] Int. Cl.[3] ..... B65H 31/06; B65H 31/30

[52] U.S. Cl. ..... 414/108; 198/628; 271/177; 271/214; 414/43; 414/104

[58] Field of Search ..... 414/43, 46, 103, 104, 414/106, 108, 109; 271/177, 181, 213, 214, 202; 198/607, 628

[56] References Cited

U.S. PATENT DOCUMENTS

| | | | |
|---|---|---|---|
| 2,725,972 | 12/1955 | Howdle | 198/628 X |
| 2,933,313 | 4/1960 | Stobb | 271/202 X |
| 3,866,905 | 2/1975 | Trogan et al. | 414/106 X |
| 4,040,618 | 8/1977 | Vermes et al. | 271/202 X |
| 4,361,318 | 11/1982 | Stobb | 271/214 X |

FOREIGN PATENT DOCUMENTS

| | | | |
|---|---|---|---|
| 1240725 | 5/1967 | Fed. Rep. of Germany . | |
| 713552 | 9/1966 | Italy | 198/628 |
| 607979 | 12/1978 | Switzerland | 271/214 |
| 1303135 | 1/1973 | United Kingdom . | |

*Primary Examiner*—Leslie J. Paperner

*Attorney, Agent, or Firm*—James W. Pearce; Roy F. Schaeperklaus

[57] ABSTRACT

A machine for forming a slug of edgewise supported flat articles. The machine includes a table above which the articles of the slug are accumulated. Paired conveyor belt means advance the articles in shingle fashion past an edge of the table. One of the belt means has a portion parallel to and at substantially the level of the table for rapidly advancing lower edges of the articles away from the other of the belt means and onto the table. An upper backstop supports the articles on the table and on said belt portion. The articles are urged toward the backstop means to form the slug. The upper backstop is advanced from said edge of the table as the slug of articles forms on the table. Control of the slug is transferred from the upper backstop to an auxiliary backstop. Upright fingers are advanced into engagement with a last article in the slug so that the slug is held between the fingers and the auxiliary backstop. The fingers and the auxiliary backstop are advanced in unison to advance the stack to a discharge station.

6 Claims, 35 Drawing Figures

FIG. 10
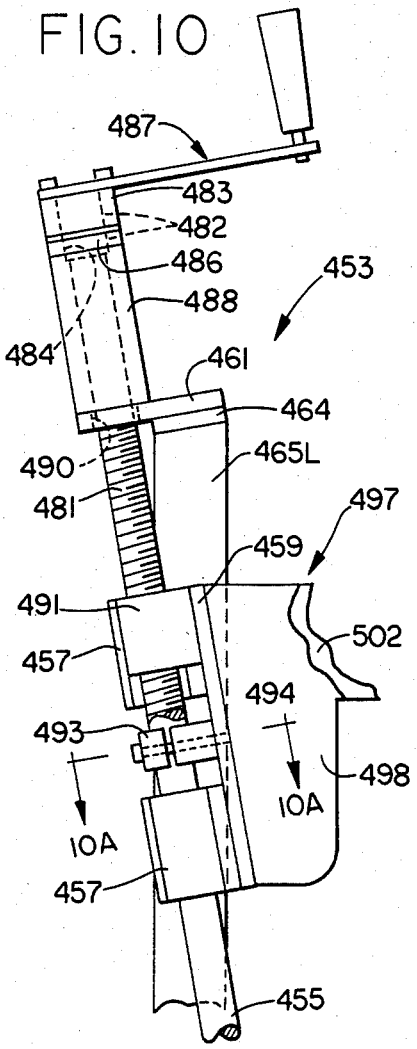
FIG. 9
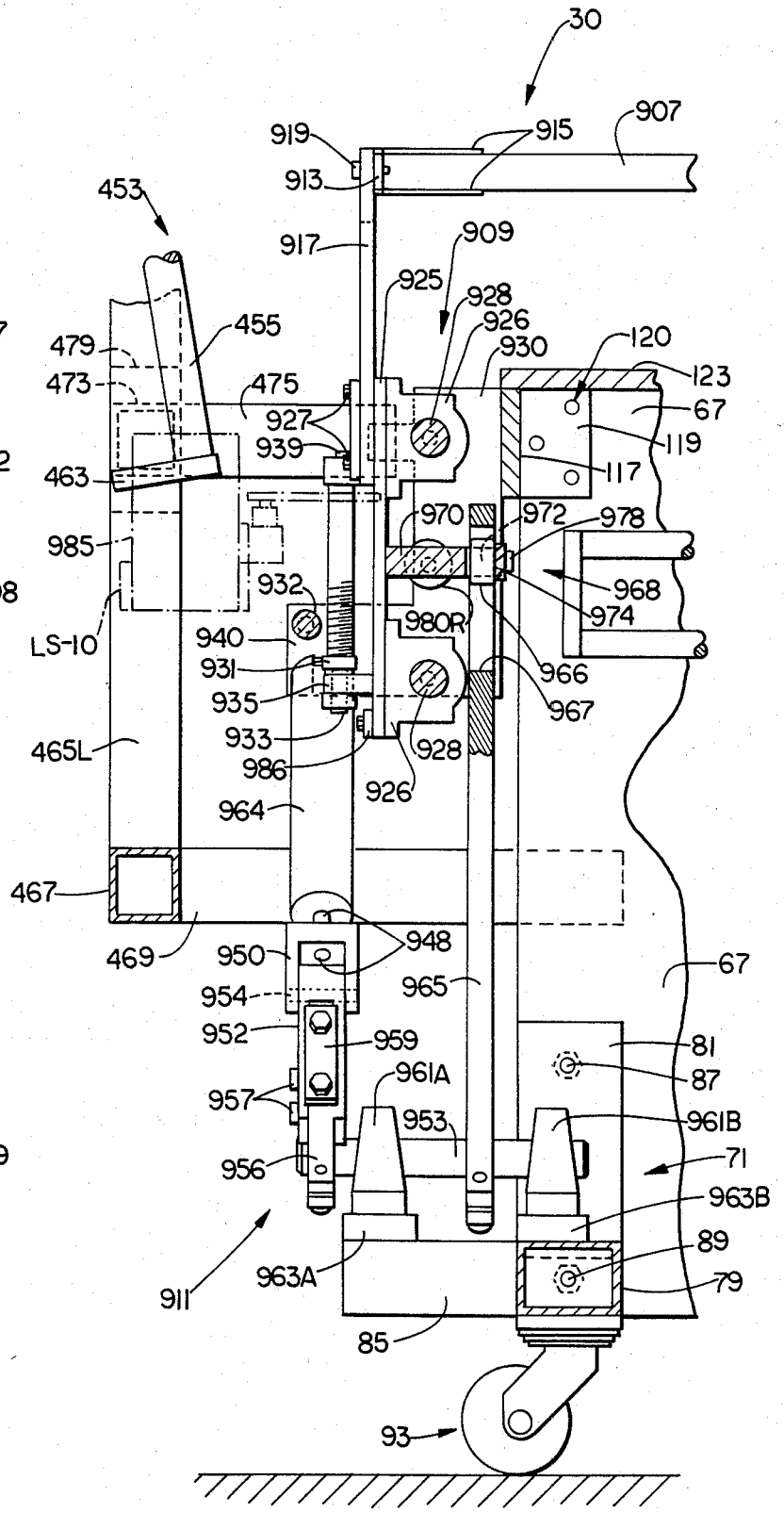
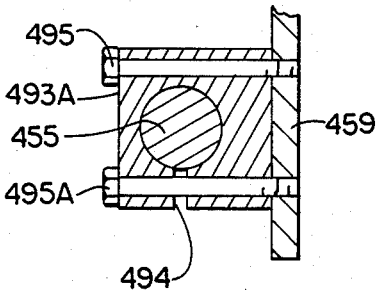
FIG. 10A

MACHINE FOR ACCUMULATING EDGEWISE SUPPORTED ARTICLES

This invention relates to a machine for accumulating flat articles such as flattened cartons in a stack.

An object of this invention is to provide a machine which feeds articles to a stack in which the articles are supported on edge on a table, accumulates a selected number of articles in the stack, and advances the stack as a unit to discharge the stack.

A further object of this invention is to provide such a machine in which the articles are advanced upwardly past an edge of the table in upright position and are advanced horizontally onto the surface of the table to collect in a stack in which the articles are supported edgewise by the table.

A further object of this invention is to provide such a machine in which the articles are resiliently urged horizontally across the table, and backup means extending upwardly of the table restrains the stack as the stack accumulates.

A further object of this invention is to provide such a machine in which the cartons are advanced upwardly between conveyor belt means, one of the conveyor belt means turning at the level of the table to provide a conveyor belt portion parallel with and at substantially the level of the table for rapidly advancing lower edges of the articles onto the table and to advance the articles away from the other conveyor belt, and to provide a space for finger means to engage the last article of the stack.

Briefly, this invention provides a machine which forms a stack of flat articles supported edgewise by a table. Paired conveyor belt assemblies advance the articles in shingle fashion past an edge of the table. One of the belt assemblies has a portion parallel to and at substantially the level of the table for rapidly advancing lower edges of the articles away from the other of the belt assemblies and into position to be supported by the table. An upper backstop supports upper portions of the articles supported by the table and on the belt portion as the stack accumulates. The articles are resiliently urged toward the upper backstop. As the stack forms, the upper backstop is advanced away from the said edge of the table to make room for the stack. The upper backstop is raised from the path of the stack and a lower backstop receives the leading article in the stack to support the stack. The flow of articles to the stack is arrested. Finger means are advanced between the other belt assembly and a last article in the stack to hold the stack against the lower backstop. The finger means and the lower backstop are advanced in unison to advance the stack to a discharge station, and a stack discharging assembly advances the stack sidewise of the fingers and of the lower backstop to discharge the stack.

The above and other objects and features of the invention will be apparent to those skilled in the art to which this invention pertains from the following detailed description and the drawings, in which:

FIG. 9 is a view in lengthwise section of a fourth section of the machine on an enlarged scale;

FIG. 10 is a fragmentary view in side elevation of an upper output corner portion of the machine on an enlarged scale, parts being broken away;

FIG. 10A is a view in section taken on the line 10A—10A in FIG. 10;

In the following detailed description and the drawings, like reference characters indicate like parts.

Introduction

Figure 1:
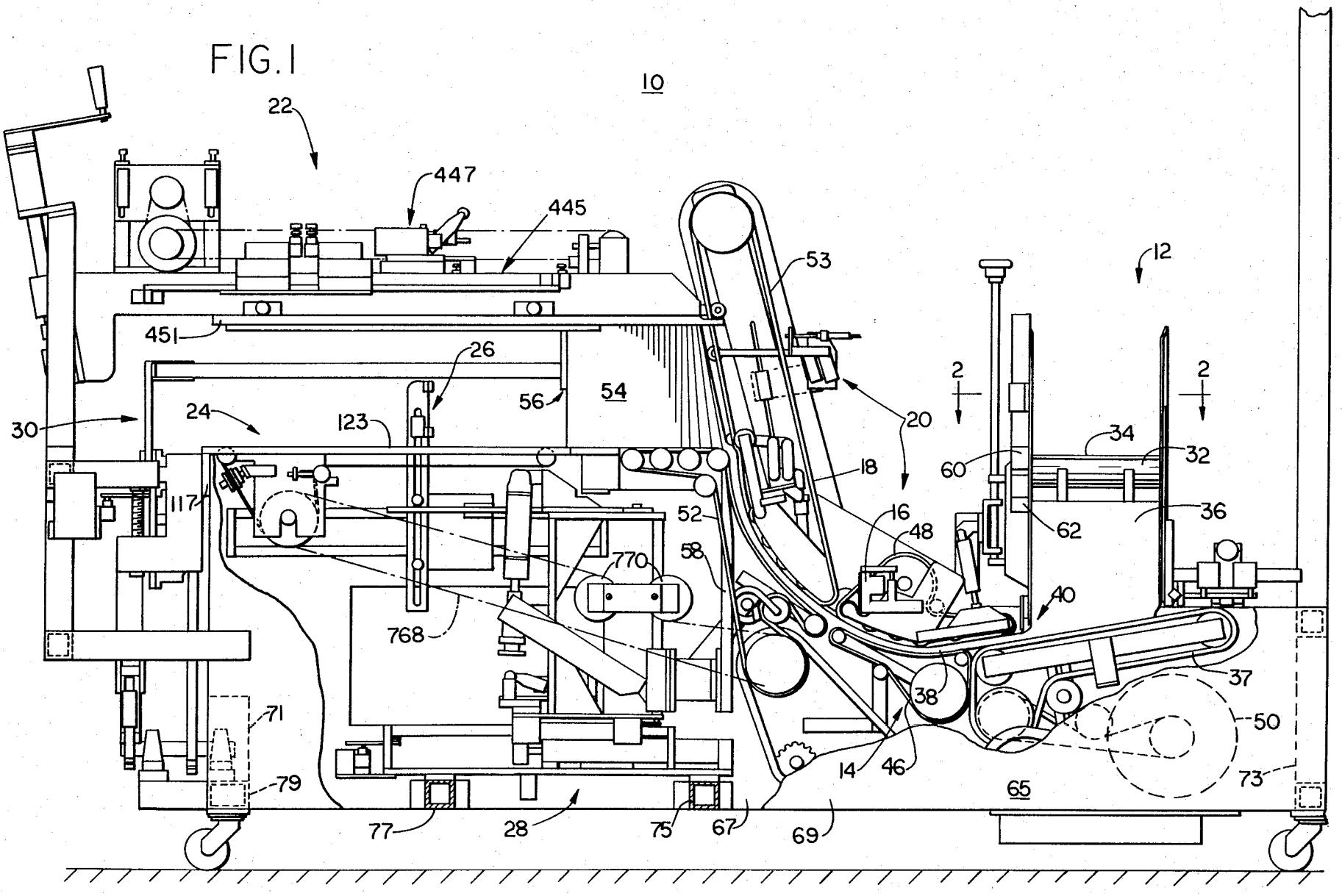
FIG. 1 is a somewhat schematic view in side elevation of a carton accumulating machine constructed in accordance with an embodiment of this invention, parts being broken away to reveal structural details.

FIG. 1 shows a slug accumulator 10 which is constructed in accordance with an embodiment of this invention. The slug accumulator 10 is comprised of an input hopper 12, paired feed belts 14, a counter assembly 16, paired incline belts 18, a microtorque control assembly 20, an upper stop assembly 22, a table assembly 24, a lower stop assembly 26, an extraction assembly 28 and a side pusher 30.

The input hopper 12 is considered the input end of the machine, and, since cartons generally travel from right to left in FIG. 1, the output end of the machine is adjacent to the side pusher 30. Any side of an object facing the input end of the machine will henceforth be termed the input face, and any side facing the output end of the machine will be termed the output face thereof. The input end of the machine may also be termed the front thereof, and the output end can also be termed the rear thereof. Looking in the direction of carton travel, the left hand side of the machine is fully visible in FIG. 1, which is also known as the operator side, and the right hand side is opposite therefrom. The longitudinal direction is any line lying in a horizontal plane that runs from input to output end, and the lateral direction is 90° to the longitudinal direction, while still remaining in a horizontal plane. Other terminology will be employed whose definitions are completely conventional.

General Operation

Figure 2:
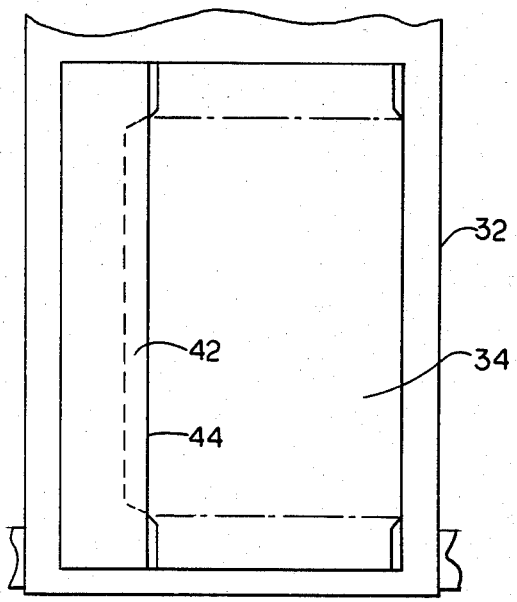
FIG. 2 is a plan view of an input conveyor of the machine taken along line 2—2 in FIG. 1 showing the orientation of entering cartons.
Figure 3:
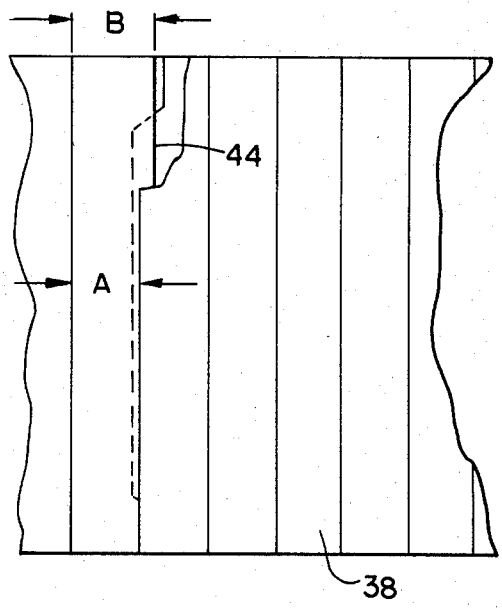
FIG. 3 is a fragmentary plan view of a shingle of cartons.

The input hopper 12 receives cartons 34 from a gluer-sealer machine (not shown) via an input conveyor 32 indicated in FIG. 1. The input conveyor 32 is synonymous with the output conveyor of the gluer-sealer machine and lies in a horizontal plane along a line normal to the line of carton progression through the slug accumulator 10, such that the flow of cartons enters the right side of the slug accumulator 10. Each carton 34, being in flattened condition, is oriented as is shown in FIG. 2 with its glue joint 42 facing upward and lying along the left side of the carton 24 with respect to the figure. The left side of the carton 34 will then be three layers thick, while the right side will be two layers thick, causing the cartons to stack unevenly. The cartons 34 drop into the input hopper 12 to form a stack of cartons 36 which consequently rests upon a hopper belt 37. The cartons of the stack of cartons 36 can be patted into upright alignment with each other within the hopper 12 by patters, not shown, to facilitate the formation of a shingle of cartons 38. The shingle of cartons 38 is formed by counterclockwise running of the hopper belt 37 which frictionally translates cartons off the bottom of the stack of cartons 36 and under a discriminator assembly 40. It is to be noted that the amount of edge separation "A" between adjacent cartons in the shingle of cartons 38 must be smaller than the distance from an exposed edge 44 of the glue joint 42 to its adjacent edge, shown by "B" in FIG. 3. Otherwise, the leading edge of one carton will butt against the exposed edge 44 of the glue joint 42 of the preceding carton, causing an interlocked relationship between adjacent cartons that will prevent stacking further on in the machine. Constructing the slug accumulator to handle only a "tight" shingle yields a high volume processor that can run at a relatively low speed.

The paired feed belts 14 (FIG. 1) are arranged in curvilinear form to cooperate with the paired incline belts 18. A lower feed belt 46 and an upper set of feed belts 48 of the paired feed belts 14 work against each other to present the shingle of cartons 38 in compressed form to the counter assembly 16. This compression eliminates gaps between adjacent cartons and holds them in a non-slip relationship, which presents the counter probe with a uniform step at a uniform separation. The counter assembly 16 utilizes a proximity switch in order to obtain the fast response time required by the slug accumulator 10. The paired feed belts 14 run in synchronized speed with the paired incline belts 18 until a slug of cartons 54 is obtained, at which time a clutch 50 is disengaged to abruptly stop the hopper belt 37 and the paired feed belts 14.

Figure 4:
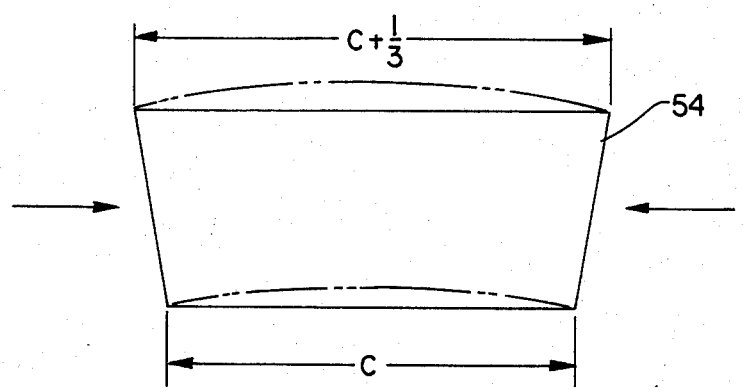
FIG. 4 is a schematic view in side elevation of a slug of cartons.

The paired incline belts 18 are also arranged in curvilinear form to bring the shingle of cartons 38 upwardly to a near vertical orientation. Cartons 34 exit the paired incline belts 18 and are stopped in their upward movement by impinging against the overhead structure of the upper stop assembly 22. The lower edges of the cartons 34 are urged onto the table assembly 24 by the upper portion of a set of bottom belts 52 of the paired incline belts 18. The bottom belts 52 pass around pulleys attached to the input end of the table assembly 24. Referring again to FIG. 2, the glue joint 42 of the cartons 34 is adjacent the leading edge thereof, thereby progressing firstly up through the belts to become the top edge of the slug of cartons 54 to be formed upon the table assembly 24. Since this edge of the flattened carton is three layers thick, as opposed to the lower edge which is two layers thick, the dimension across the top of a compressed slug of cartons 54 can theoretically be substantially longer than the bottom dimension "C" as is shown in FIG. 4. When such a slug is picked up off a supporting surface by a clamping action against the ends thereof, an upward bow will occur, as indicated in double dot-dash lines, producing an interlocking wedge action that will permit the slug of cartons 54 to be lifted and transported.

The paired incline belts 18 run at two adjustable speeds, high and low. Low speed is called for when the level of cartons in the input hopper 12 is below a first photocell assembly 60. High speed is called for if the carton level rises above the first photocell assembly 60. A second photocell assembly 62 is provided that will shut off the hopper belt 37 and the paired feed belts 14 to cause the slug accumulator to pause until more cartons are provided from the input conveyor 32. Low speed is provided to downshift the machine to lengthen the time interval required to reduce the carton level from the first to second photocell. High speed is provided to prevent the carton level in the input hopper 12 from rising above the input conveyor 32.

The slug of cartons 54 proceeds to expand upon the table assembly 24 under the control of an upper backstop 56. The upper backstop assembly 56 moves toward the output end of the machine under the control of the microtorque control assembly 20. As the slug of cartons 54 approaches the lower stop assembly 26, the upper backstop 56 is raised out of contact with the slug of cartons 54, thereby transferring control of the slug to the lower stop assembly 26. Shortly thereafter, the hopper belt 37 and the paired feed belts 14 are stopped. The paired incline belts 18 continue to run delivering all counted cartons to the table assembly 24. After the last carton of the slug has been advanced into position for support by the table assembly 24, a set of fingers 58 of the extraction assembly 28 is raised in front of the slug of cartons 54. The set of fingers 58 translates with the lower stop assembly 26 toward the output end of the machine to move the slug of cartons 54 into a discharge position upon the table assembly 24, the discharge position of the fingers being shown in double dot-dash lines at 58A in FIG. 23. The distance between the pair of fingers 58 of the extraction assembly 28 and the lower stop assembly 26 is adjustable to accommodate different slug lengths.

The finished slug of cartons 54, being placed upon the discharge table 24 at the discharge location, can now be ejected from the slug accumulator 10 by the side pusher 30 onto a discharge system, not shown. This preferred embodiment is configured to eject the slug of cartons 54 to the left thereof.

Frame

Figure 7:
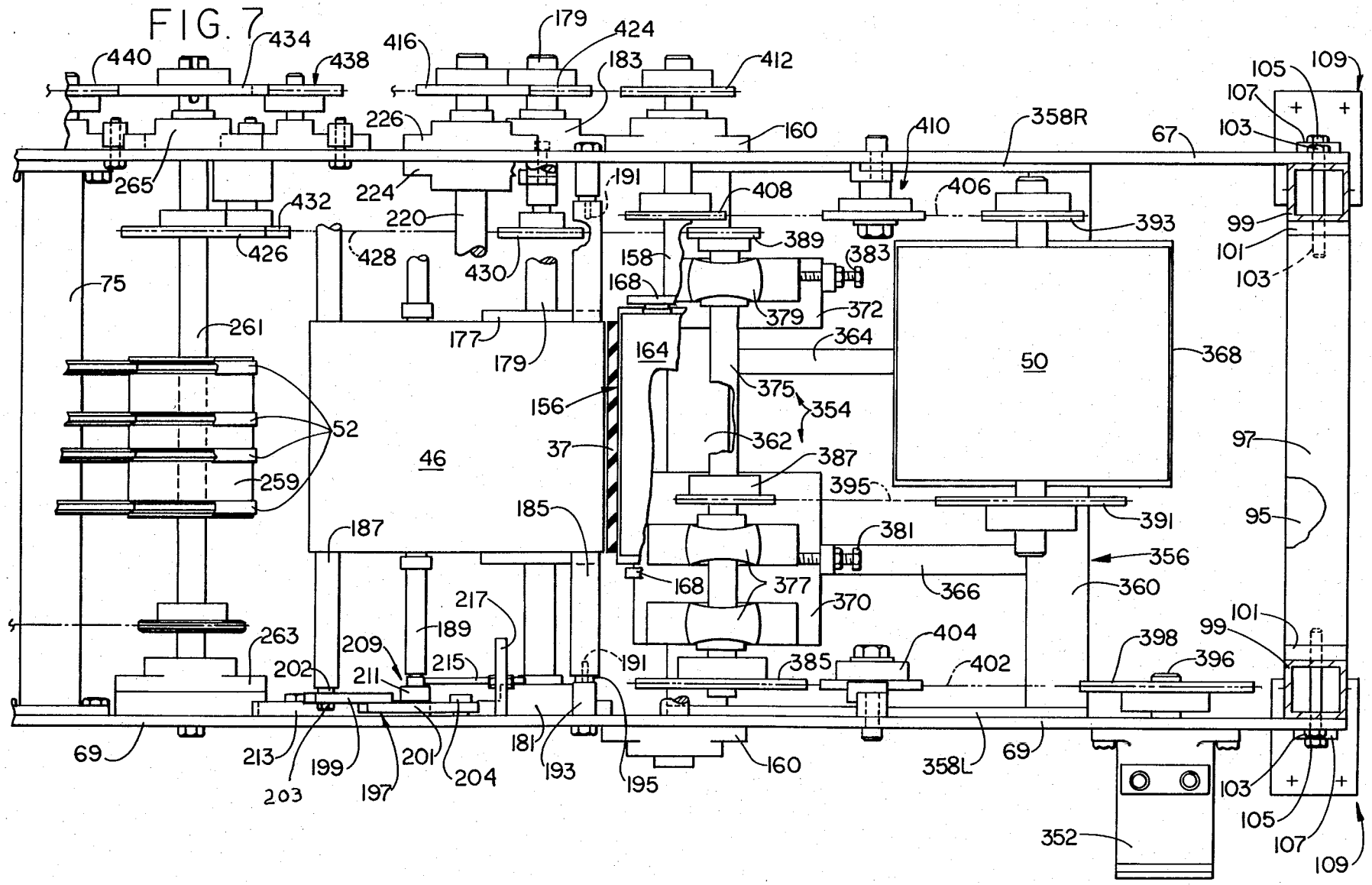
FIG. 7 is a top plan view of the sections of the machine shown in FIGS. 5 and 6, parts being broken away to show interior structure.

The subassemblies of the slug accumulator 10 are held in spaced relationship with each other by a main frame 65 that incorporates two large heavy gauge side plates, one right hand 67 and one left hand 69, as is shown in FIGS. 1 and 7. The right and left hand side plates 67 and 69, respectively, extend from the input end of the slug accumulator 10 to the side pusher 30 adjacent the output end. Toward the input end, the plates rise vertically from the bottom to just above the hopper belt 37, and toward the output end they rise from the bottom to the table assembly 24. The right and left side plates 67 and 69, respectively, are held in spaced parallel relationship by a lower output frame 71, an input frame 73, a first lateral member 75, a second lateral member 77, an upper output plate 117, and the table assembly 24.

Figure 5:
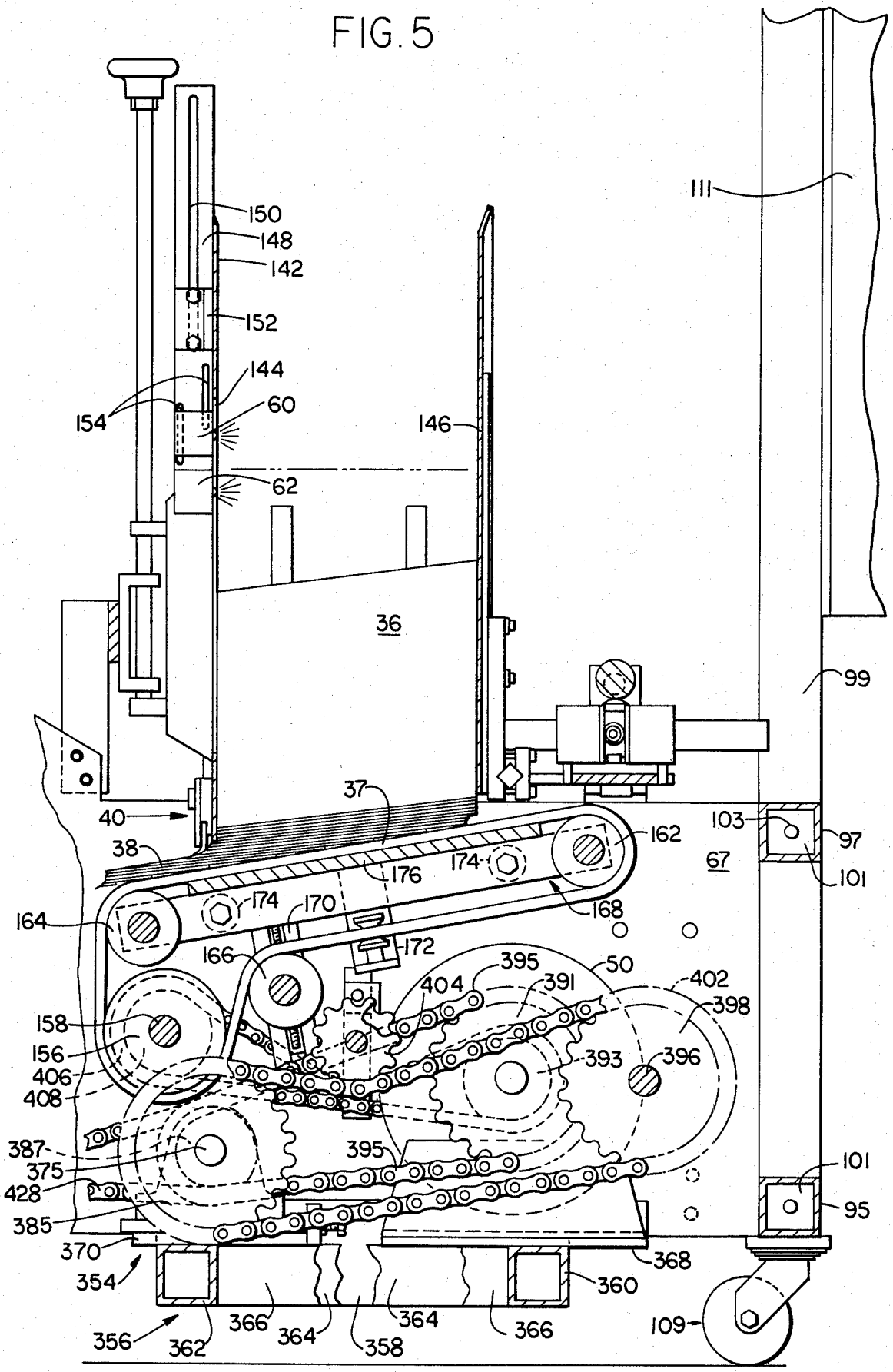
FIG. 5 is a view in lengthwise section of a first section of the machine on an enlarged scale, parts being broken away to reveal details of construction.

The input frame 73 as shown in FIGS. 1, 5 and 7 is comprised of a bottom input lateral brace 95, an upper input lateral brace 97 and a pair of input posts 99. The bottom and upper lateral braces 95 and 97, respectively, incorporate a heavy end cap 101 rigidly affixed to each extremity thereof. The input posts 99 are rigidly affixed at lower inboard ends to the outboard extremities of the bottom input lateral brace 95 inclusive of the end caps 101. The upper input lateral brace 97, inclusive of its end caps 101, is likewise rigidly affixed between the input posts 99 at a height commensurate with the height of the right and left hand side plates 67 and 69, respectively. The input frame 73 is fixedly attached between the side plates 67 and 69 by a pair of bolts 103 that pass through clear holes in the upper input corners of the side plates 67 and 69, through cooperating clear holes in the input posts 99, to threadably mount into the heavy end caps 101 associated with the upper input lateral brace 97. The lower end of the subassembly is similarly attached by a pair of bolts 105 by first passing clear through vertical mounting flanges 107 of a pair of caster assemblies 109. The input posts 99 rise substantially upward to provide structure upon which to mount an equipment box 111 for electric equipment as required.

The first lateral brace 75 (FIGS. 1, 8 and 11) is rigidly affixed with end flanges 113 that provide clear holes for a set of bolts 115 for fixedly attaching the brace 75 across the lower portion of the sideplates 67 and 69 at about their middle. The second lateral member 77 is mounted between the side plates 67 and 69 in the same manner and spacedly located between the lower output frame 71 and the first lateral member 75.

The lower output frame 71, as shown in FIGS. 1, 9, 11 and 12, is comprised of an output lateral bar 79, a right end mount 81, a left end mount 83 and a central cantilever bar 85. Upper portions of the end mounts 81 and 83 are attached to the side plates 67 and 69, respectively, by bolts 87. Lower portions of the end mounts 81 and 83 are similarly attached by bolts 89. Each of the bolts 89 also passes through a mounting flange 91 of one of a pair of caster assemblies 93.

Figure 12:
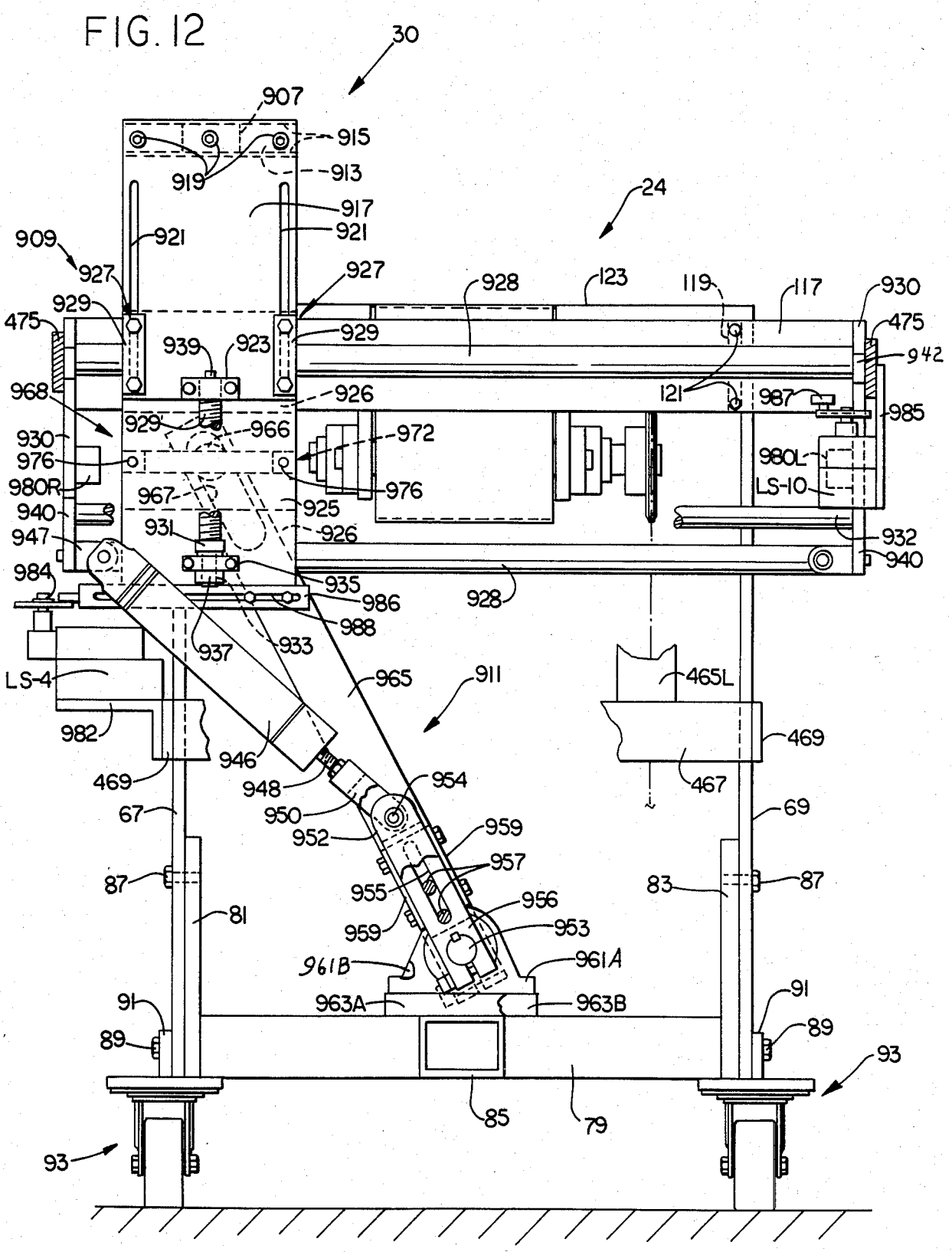
FIG. 12 is a view in end elevation of the machine on an enlarged scale, parts being broken away and in section to reveal structural details.

The upper output corners of the side plates 67 and 69 are fixedly held in lateral spaced and parallel relationship by the upper output plate 117 (FIGS. 1, 9, 12 and 13). A pair of mounting flanges 119 is fixedly attached to the input surface of, and inboardly the ends of the upper output plate 117 by a set of four countersunk bolts 121 (FIG. 12). In turn, the mounting flanges 119 are fixedly attached to the inboard surfaces of the right and left side plates 67 and 69 by a set of bolts 120 that pass through clear holes in the side plates to threadably mount in the pair of mounting flanges 119.

The table assembly 24 incorporates a main plate 123 (FIGS. 1, 9, 12 and 13) that is also utilized to stabilize the main frame 65. The output edge of the main plate 123 is fixedly attached upon the top edge of the upper output plate 117 by a set of four countersunk screws 125 (FIG. 13) and to the upper edges of the pair of mounting flanges 119 by a pair of countersunk screws 127. The input portion of the main plate 123 is fixedly attached to the side plates 67 and 69 by a pair of countersunk screws 128 that pass through openings in the main plate 123 to threadably mount in a pair of mounting blocks 129. The mounting blocks 129 in turn are fixedly attached to the inboard surfaces of the right and left hand side plates 67 and 69, respectively.

Figure 6:
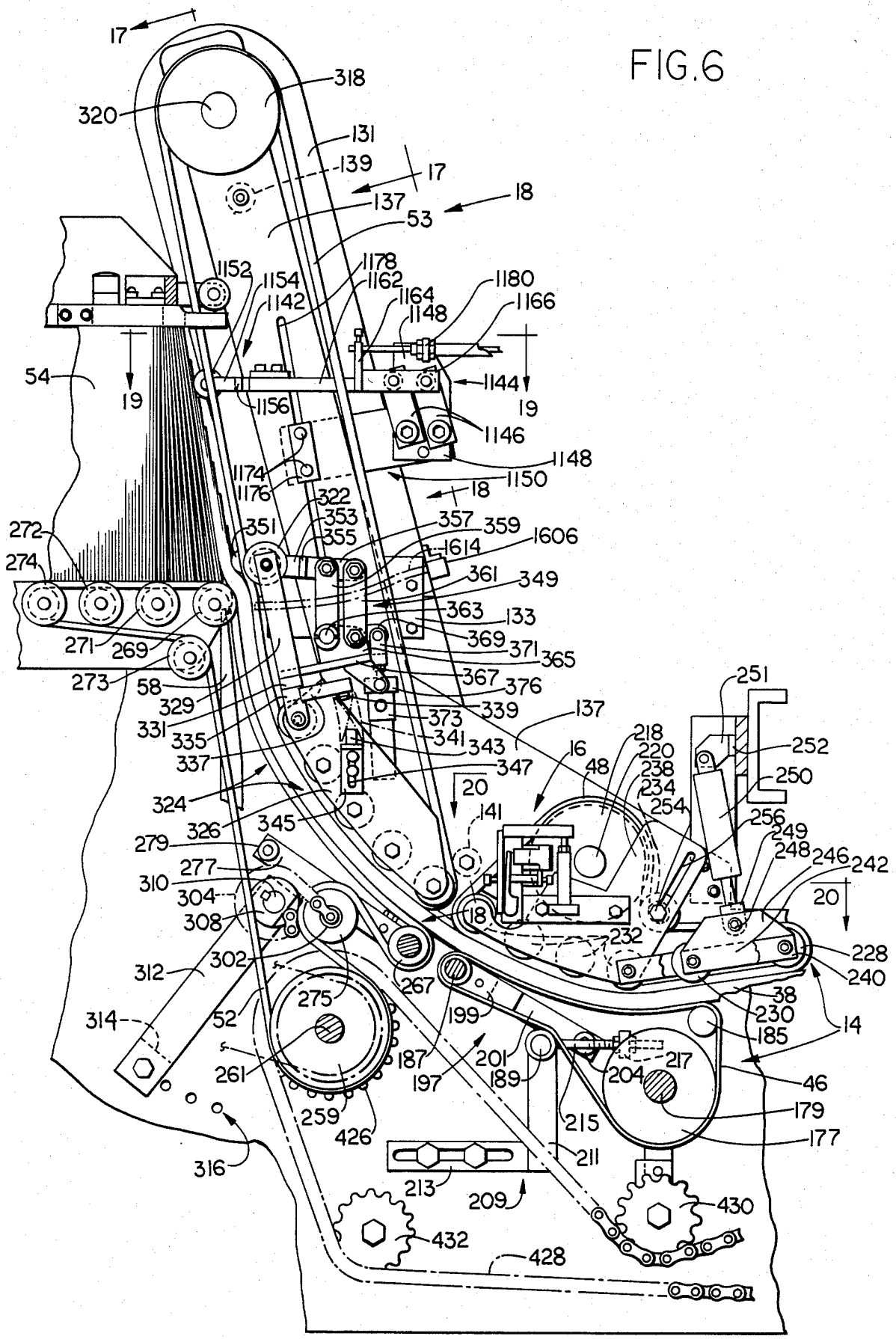
FIG. 6 is a view in lengthwise section of a second section of the machine on an enlarged scale.
Figure 16:
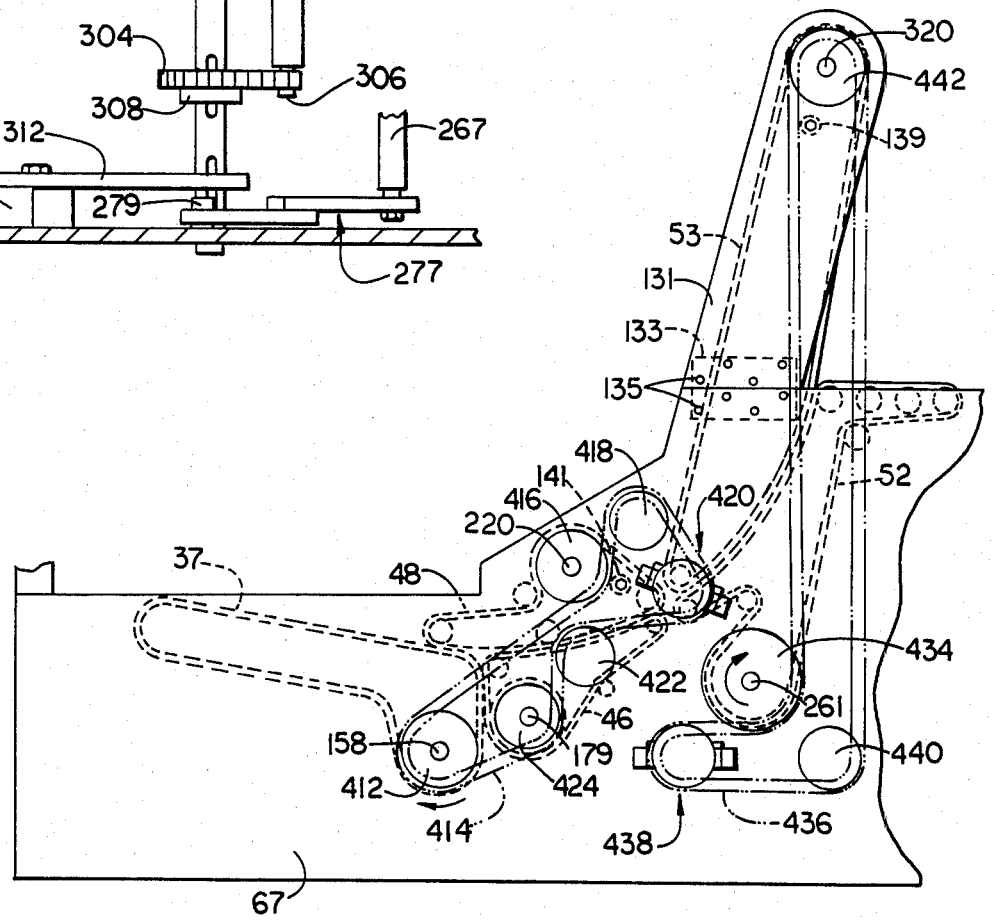
FIG. 16 is a fragmentary view in side elevation of a right hand side of the machine.

Extending upwardly from the middle portion of the right hand side plate 67 is a side plate extension 131 shown best in FIGS. 6 and 16. It is fixedly attached to the top edge of the right hand side plate 67 by means of a joiner plate 133 that is fixedly attached to the inboard surfaces thereof by a plurality of bolts 135.

Figure 20:
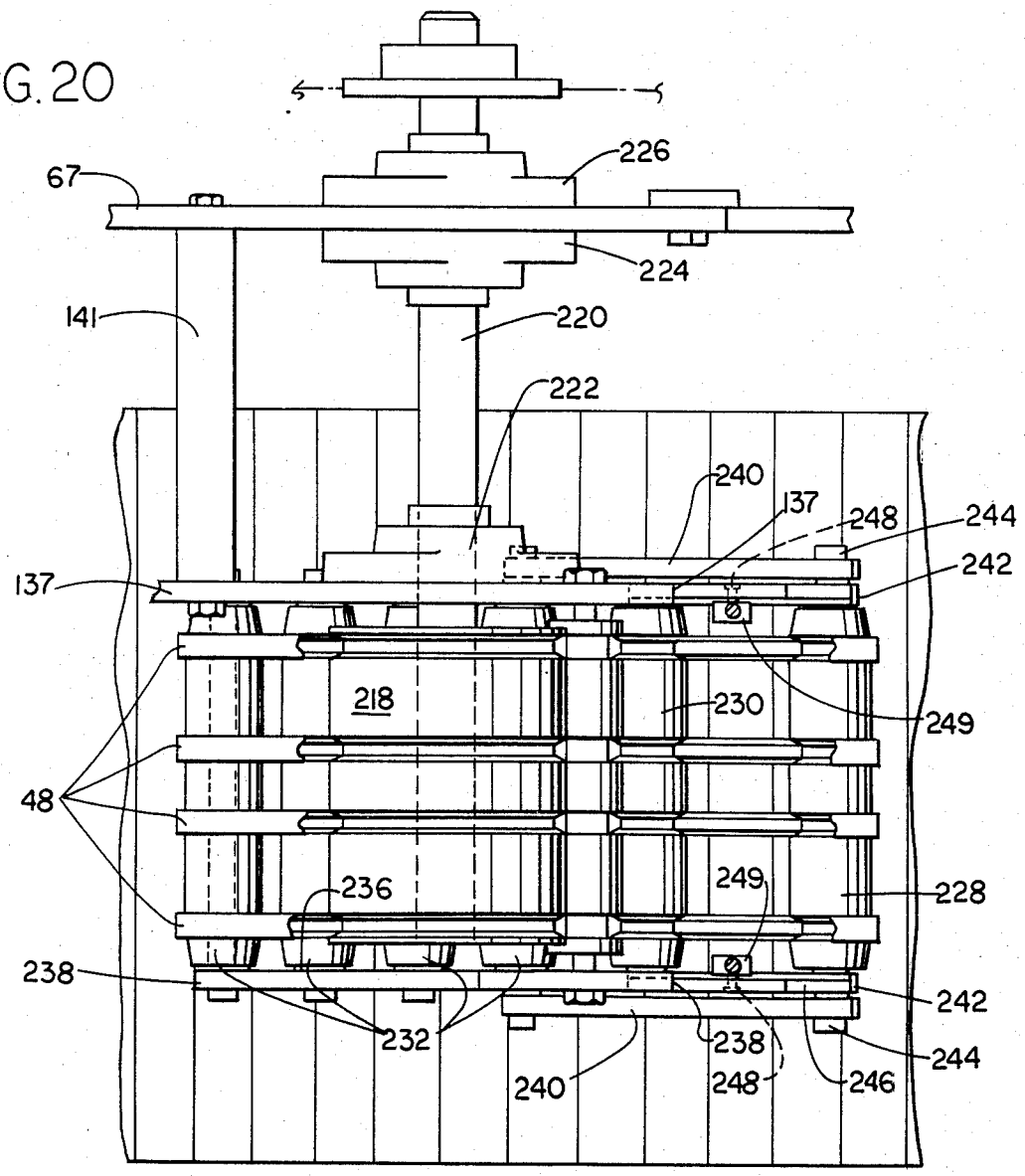
FIG. 20 is a view in section taken on the line 20—20 in FIG. 6.

Referring now to FIGS. 6 and 20, a belt plate 137 is suspended inboardly from the right hand side plate 67 and side plate extension 131 by an upper standoff bar 139 and a lower standoff bar 141. The standoff bars 139 and 141 are fixedly attached at both their inboard and outboard extremities. The irregular shape of the belt plate 137 resembles a goalie's hockey stick, the lower "paddle" portion functioning as mounting structure for the upper set of feed belts 48, and the upper "handle" portion functioning as mounting structure for a set of top belts 53 of the paired incline belts 18. FIGS. 16, 17, 18 and 20 also show the belt plate 137 and its mounting in lateral views.

Feed Assembly

The input hopper 12 is shown most fully in FIG. 5. The input hopper includes an output guide plate 143 possessing a narrow vertical slot 144 through which light is directed from the first and second photocell assemblies 60 and 62. These photocell assemblies are both emitters and receivers. The cartons 36 serve as reflectors. The photocell assemblies 60 and 62 are activated by the presence of the stack of cartons 36. The second photocell assembly 62 is fixedly attached to a vertical bar 148, the upper portion of which incorporates a slot 150. The slot 150 provides for adjustable mounting to a mount bracket 152 that is in turn rigidly affixed to the upper output surface of the output guide plate 142. This permits substantial vertical adjustment of the second photocell assembly 62 to accommodate various stack depths appropriate to different size cartons. The lower portion of the vertical bar 148 also incorporates a pair of staggered slots 154 that cooperate with the mounting holes of the first photocell 60. This provides for vertical adjustment of the first photocell 60 in relation to the second photocell 62 in order to provide the most constant operation of the slug accumulator 10.

The shingle of cartons 38 is formed from the bottom of the stack of cartons 36 by virtue of the hopper belt 37 and the discriminator assembly 40. The shingle of cartons 38 passes into the paired feed belts 14 (FIG. 6), under the counter assembly 16, and then into the paired inclined belts 18. As is shown in FIGS. 5 and 7, counterclockwise motion is imparted to the hopper belt 37 by means of a first drive roller 156 that is in turn fixedly mounted on a first drive shaft 158. The first drive shaft 158 is rotatably mounted in bearings 160 that are in turn fixedly attached to the outboard surfaces of the side plates 67 and 69. The hopper belt 37 circumscribes an input roller 162, an output roller 164 and is held in proper tension by a tension roller 166. The input and output rollers 162 and 164, respectively, are held in rotatable and spaced relationship by a hopper belt frame 168 that in turn provides mounting for a tension roller jack mount 170 and a lateral roller guide assembly 172. The hopper belt frame 168 is fixedly mounted between the right and left side plates 67 and 69, respectively, by a set of four bars 174. The bars are fixedly attached to the outboard surface of the hopper belt frame 168 and extend outboardly to be fixedly attached to the inboard surfaces of the side plates 67 and 69. A belt plate 176 is rigidly affixed across the top of the hopper belt frame 168 to support the hopper belt 37.

Lower Feed Belt

Counterclockwise rotation is imparted to the lower feed belts 46 (FIGS. 6 and 7) by a second drive roller 177 that is in turn fixedly attached to a second drive shaft 179. The second drive shaft 179 is rotatably mounted in a bearing 181 (FIG. 7) that is in turn fixedly mounted to the inboard surface of the left hand side plate 69. The second drive shaft 179 is also rotatably mounted through a second bearing 183 that is fixedly mounted to the outboard surface of the right hand side plate 67. The lower feed belt 46 circumscribes a feed input roller 185 and a feed output roller 187 and is properly tensioned by a feed tension roller 189. The feed input roller 185 is rotatably mounted to the inboard surfaces of the side plates 67 and 69. Each end of the shaft is bored and fitted with a bushing to receive a pin 191 that is in turn rigidly affixed in a spacer block 193. A thrust washer 195 intervenes between the end of the feed input roller 185 and the spacer block 193. Finally, the spacer blocks 193 are fixedly attached to the inboard surfaces of the side plates 67 and 69.

The feed output roller 187 is rotatably mounted between the output ends of a pair of radius arms 197. Each extremity of the feed output roller 187 is drilled and threaded in order to fixedly receive bolts 203 that pass through clear bushinged holes in the radius arms 197 and through thrust washers 202. Each member of the pair of radius arms 197 is comprised of two pieces of bar stock. An output piece 199 is rigidly affixed to an input piece 201 in overlapping manner to provide clearance for the bolts 203 of the feed output roller 187. Input ends of the radius arms 197 are pivotally mounted to the inboard surfaces of the side plates 67 and 69 by shoulder bolts 204.

Figure 15:
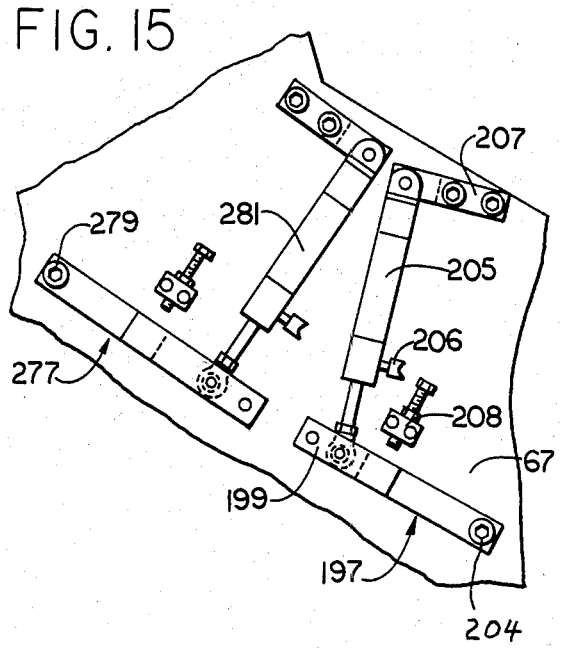
FIG. 15 is a fragmentary view in side elevation of belt pressuring assemblies of the machine.

Referring now to FIGS. 6 and 15, the upper portion of the lower feed belt 46 is urged upwardly into curvilinear contact with the shingle of cartons 38 by the clockwise pivoting of the pair of radius arms 197 about the bolts 204. Each member of the pair of radius arms 197 is pivoted clockwise by a cylinder 205. The cylinder 205 is pivotally attached to a pivot mount 207 that is in turn fixedly attached to the inboard surface of its respective side plate 67 and 69. The working ends of the cylinder rods of the cylinders 205 are pivotally mounted to the outboard surfaces of the output pieces 199 of the pair of radius arms 197. The cylinders 205 are of the reverse single acting type so that as air is supplied through lines 206, the cylinder rods retract, thus holding the assembly in pressured contact with the shingle of cartons 38. As the shingle of cartons 38 can be of different thicknesses, the cylinders 205 provide a constant pressure for each. When no shingle is present, the cylinders 205 retract until the pair of radius arms 197 come against adjustable stops 208 that are in turn fixedly mounted to the inboard surfaces of the side plates as shown.

The feed tension roller 189 is rotatably mounted between the upper ends of a pair of mounting brackets 209 (FIGS. 6 and 7). Each member of the pair is composed of a vertical piece 211, a horizontal piece 213, an adjustment screw 215 and a screw mount 217. The extremities of the tension roller 189 are bored, fitted with a bushing, and mounted on a pin imbedded in the upper end of the vertical piece 211 in the same manner as the feed input roller 185, the only difference being that the pin is long enough the accommodate the eye of the adjustment screw 215. The adjustment screw is captured in a clear hole in the screw mount 217 by a pair of nuts used to adjust and assist in locking the feed tension roller 189 in place. The lower outboard surface of the vertical piece 211 is rigidly affixed to the input end of and upon the inboard surface of the horizontal piece 213 in order to clear the pair of radius arms 201. The horizontal piece 213 incorporates a slot through which bolts pass to provide the pair of mounting brackets 209 with horizontal adjustment and secure attachment to the inboard surfaces of the side plates 67 and 69 of the slug accumulator 10.

Upper Feed Belt

As can be seen in FIGS. 6, 7 and 20, clockwise rotation is imparted to the upper set of feed belts 48 by means of a third drive roller 218 that is fixedly attached in cantilever manner to the left hand end of a third drive shaft 220. The third drive shaft 220 passes from the third drive roller 218 to the right of the slug accumulator 10 through a clear hole in the lower portion of the belt plate 137, and through a first bearing 222 (FIG. 20). The first bearing 222 is fixedly attached to the outboard surface of the belt plate 137. The third drive shaft 220 continues to the right and passes through a second and third bearing 224 and 226, respectively, (FIG. 7). The second bearing 224 is fixedly attached to the inboard surface of the right side plate 67 while the third bearing 226 is similarly attached to the outboard surface of the same plate. This array of bearings gives a high degree of stability and rigidity to the cantilever end of the third drive shaft 220. It is to be noted that the third drive roller 218 is grooved to cooperate with each belt of the upper set of feed belts 48 which are "V" belts.

Along with the third drive roller 218, the upper set of feed belts 48 circumscribes a first intake roller 228, a second intake roller 230, and a set of four contour rollers 232, and is properly tensioned by a tension roller 234. Each roller of the set of four contour rollers 232 is essentially a tube that is rotatably mounted by a pair of ball bearings upon a bearing shaft 236 (FIG. 20). The bearing shafts 236, four in all, are fixedly attached at their right hand extremities in curvilinear and spaced arrangement along the lower left hand surface of the belt plate 137. Extending to the left then in cantilever form, the left hand extremities of the bearing shafts 236 are held in fixed relationship with each other by means of a partial belt plate 238. Referring again to FIGS. 6 and 20, a pair of radius arms 240 extend in the input direction from the lower input corner of the belt plate 137 and the partial belt plate 238. The output ends of the radius arms 240 are pivotally attached upon the same fasteners that hold the input most bearing shaft 236 associated with the set of four contour rollers 232. The input ends of the radius arms 240 function as mounting for a secondary pair of radius arms 242 and the first intake roller 228. As before, the first intake roller 228 is bearing mounted on a bearing shaft (not shown in detail), the bearing shaft being fixedly attached between the input ends of the secondary pair of radius arms 242 by means of shoulder bolts 244 whose shoulders extend outboardly to be pivotally mounted through the input end of the pair of radius arms 240. The output ends of the secondary pair of radius arms 242 provide mounting as before for the second intake roller 230. The secondary pair of radius arms 242 integrally incorporates an upper extension 246. A shoulder bolt 248 passes inboardly through a clear counterbored hole in the upper extension 246 to threadably mount in rod ends 249. The rod ends 249 are threadably and fixedly attached to working ends of a pair of cylinders 250. The upper ends of the cylinders 250 are pivotally mounted to lugs 251 that are in turn rigidly affixed to a spanner bar 252. The spanner bar 252 is fixedly attached to the mounting structure of the discriminator assembly 40. By virtue of the double radius arm assembly, the first and second intake rollers 228 and 230, respectively, are free to move independently, providing a constant and measurable downward force to be applied to shingles of different thickness.

The upper set of feed belts 48 is held in proper tension by the tension roller 234 that is rotatably mounted by means of a pair of ball bearings to a tension roller shaft that is in turn adjustably mounted by a pair of bolts 254 that pass through slots 256 in the belt plate 137 and the partial belt plate 238.

Incline Belts (Lower)

Figure 14:
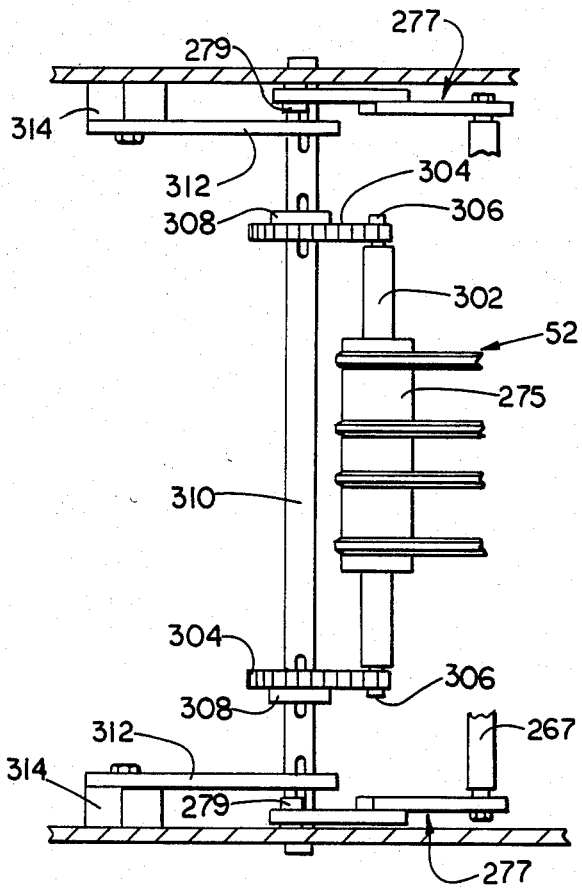
FIG. 14 is a fragmentary plan view, partly in horizontal section, of a belt tensioning assembly of the machine.

The set of bottom belts 52 of the paired incline belts 18 is motivated in counterclockwise rotation by a fourth drive roller 259 that is in turn fixedly attached to a fourth drive shaft 261 as is shown primarily in FIGS. 6, 7 and 14. The left hand end of the fourth drive shaft 261 is rotatably mounted in a left side bearing 263 that is in turn fixedly attached to the inboard surface of the left side plate 69. The right hand end of the fourth drive shaft 261 is rotatably mounted through a right side bearing 265. The right side bearing 265 is fixedly attached to the outboard surface of the right side plate 67.

The set of bottom belts 52 circumscribes a bottom input roller 267, a first set of top pulleys 269, a second set of top pulleys 271, a third set of top pulleys 272, a fourth set of top pulleys 274, a set of back pulleys 273, and a takeup roller 275. The bottom input roller 267 is rotatably mounted between the free ends of a pair of incline radius arms 277 in generally the same manner as the feed output roller 187 is mounted between the pair of radius arms 197 as previously described. The incline radius arms 277 are pivotally attached at their output ends to the inside surfaces of the side plates 67 and 69 by shoulder bolts 279 and appropriate thrust washers. The pair of incline radius arms 277 is constructed and controlled in a similar manner to that of the pair of radius arms 197 as previously described and as is shown in FIG. 15. Only slight dimensional differences and orientation constitute the physical differences, while the end result is to pressure the sloping input segment of the set of bottom belts 52 into arcuate contact with the output surface of the shingle of cartons 38. The radius arms 277 are urged upwardly by cylinders 281, only one of which is shown in FIG. 15.

Figure 8:
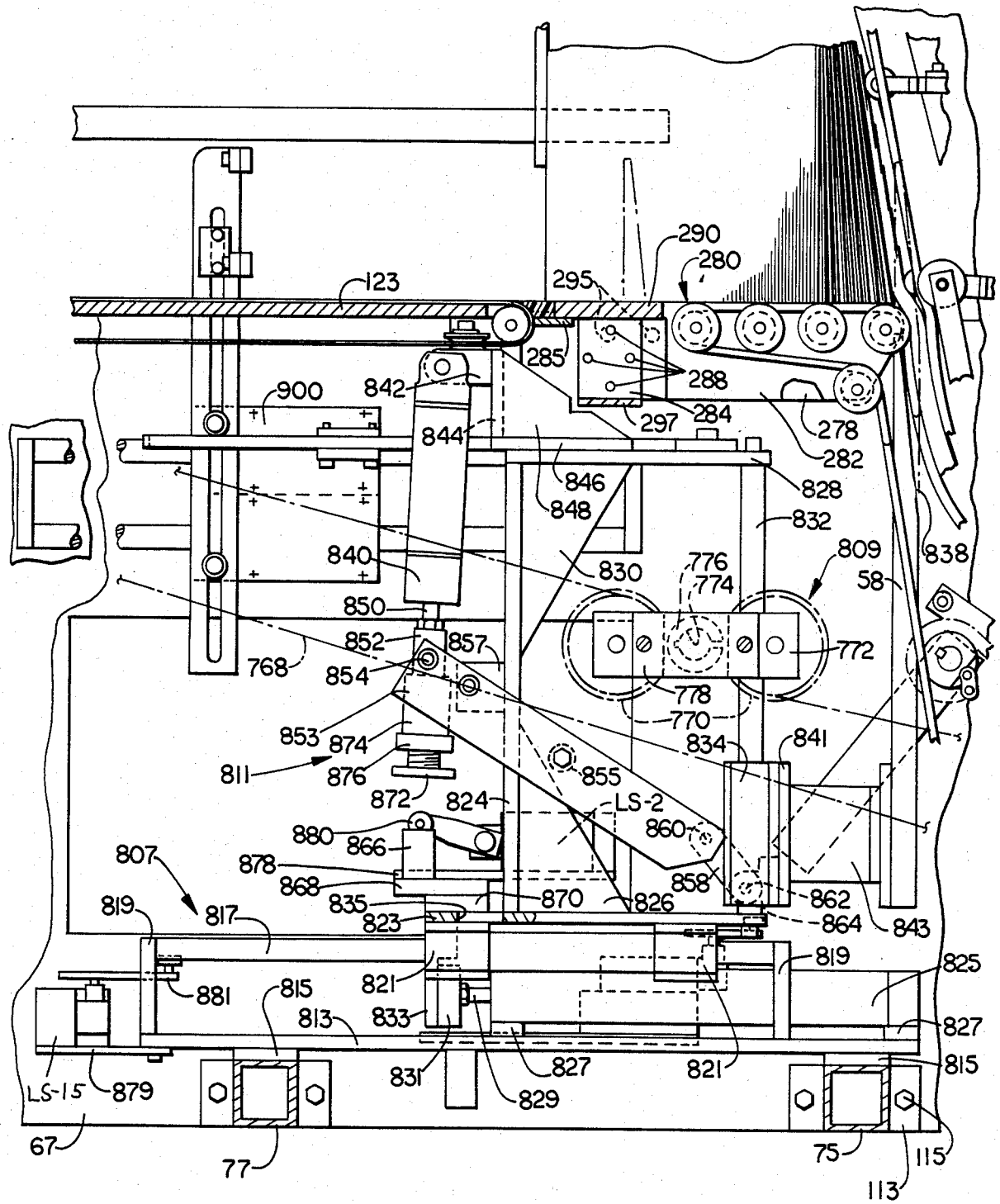
FIG. 8 is a view in lengthwise section of a third section of the machine on an enlarged scale.
Figure 13:
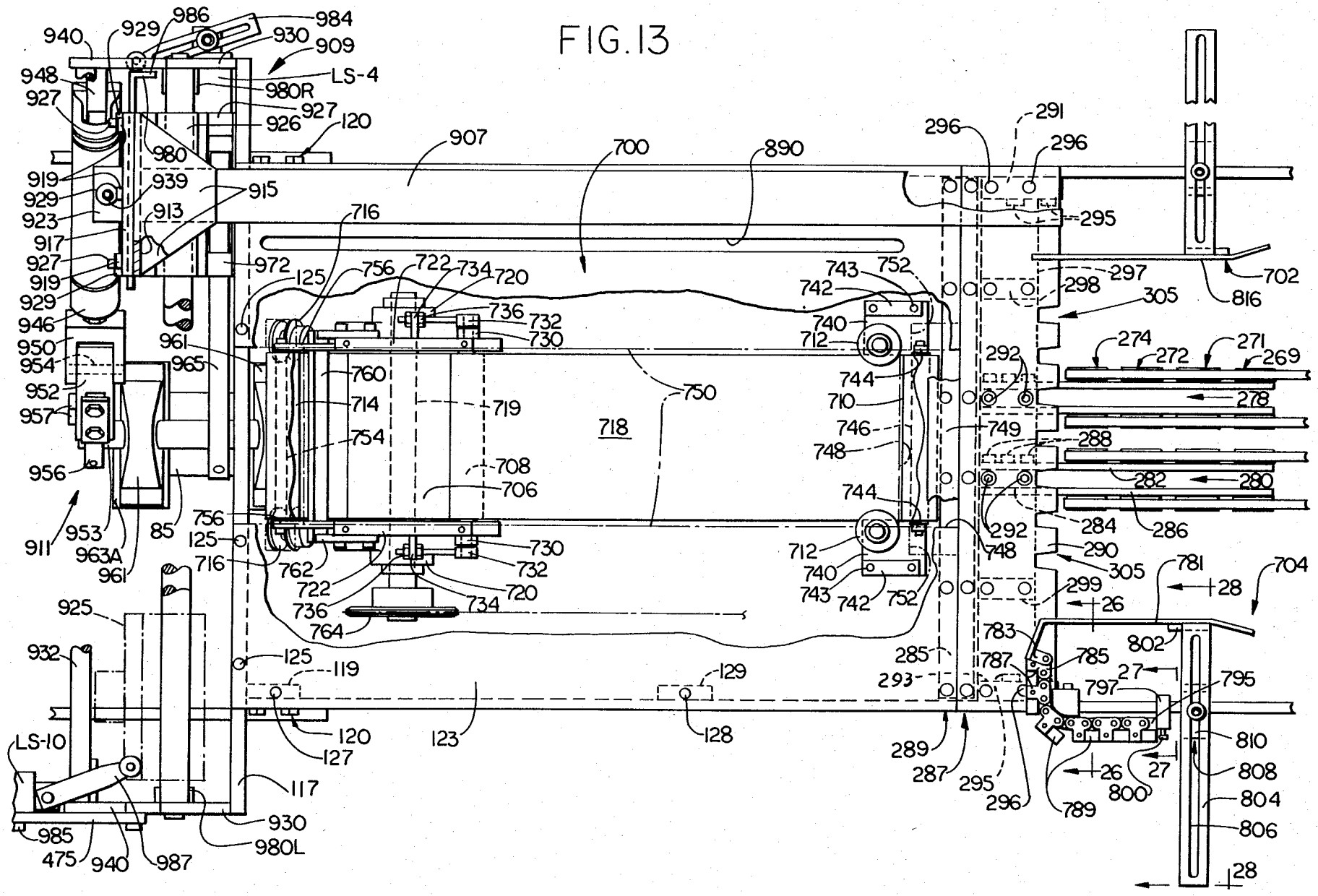
FIG. 13 is a top plan view of an output portion of the machine on an enlarged scale, parts being broken away and in section.

The set of bottom belts 52 of the paired incline belts 18 rises curvilinearly upward to pass over the first, second, third and fourth sets of top pulleys 269, 271, 272, 274, respectively, as is shown in FIGS. 6, 8 and 13. As FIG. 13 shows, each set of pulleys is comprised of four individual pulleys, the matrix of 16 pulleys rotatably mounted upon a right and left hand pulley mount assembly 278 and 280, respectively.

The left hand pulley mount assembly 280 is comprised of a right hand roller plate 282, a spacer mount 284, and a left hand roller plate 286. The right hand roller plate 282 is fixedly held in spaced and parallel relationship with the left hand roller plate 286 by a set of four bolts 288 that pass through clear holes in the output portion of the right hand roller plate 282, through clear holes in the spacer mount 284, and threadably and fixedly mount into the output portion of the left hand roller plate 286. Four cantilever shafts, fixedly and spacedly mounted, protrude outboardly from both the right and left hand roller plates 282 and 286, respectively, to rotatably accommodate by means of ball bearings, half the pulleys of the first, second, third and fourth sets of top pulleys 269, 271, 272, 274, respectively. The right hand pulley mount assembly 278 is identical in construction to the left hand pulley mount 280. They are mounted in spaced and parallel relationship about the centerline of, and to the underside of a table input plate 290. Flat head bolts 292 pass through clear and countersunk holes in the table input plate 290 to threadably and fixedly mount into the spacer mount blocks 284. Both the right and left hand roller plates 282 and 286, respectively, are so constructed so as to conform with the input edge of the table input plate 290, thus making the extended top edge of the roller plates level with the top surface of the table assembly 24.

The table input plate 290 is fixedly attached to the input edge of the main plate 123 of the table assembly 24 by a connector bar 285. A set of six screws 287 passes downwardly through clear and counterbored holes in the output edge of the table input plate 290 to threadably mount into the input edge of the connector bar 285. Similarly, screws 289 pass downwardly through a set of six clear and counterbored holes in the input edge of the main plate 123 to threadably and fixedly mount in the trailing edge of the connector plate 285. The attachment of the table input plate 290 is rigidized by a right and left corner block 291 and 293. A pair of bolts 295 passes laterally outward through a pair of clear holes in the right and left corner blocks 291 and 293, respectively, to threadably mount into their respective right and left hand side plates 67 and 69. Bolts 296 pass downwardly through clear and countersunk holes in the top outboard surfaces of the table input plate 290 to threadably mount into the right and left corner blocks 291 and 293. A spanner plate 297 is similarly attached across the bottom edges of the right and left corner blocks 291 and 293, respectively, and the two spacer mounts 284. The spanner plate 297 adds lateral rigidity to the right and left hand pulley mount assemblies 278 and 280, respectively. Further rigidity is added to the table input plate 290 by incorporating a right hand spacer block 298 and a left hand spacer block 299. The right hand spacer block 298 is fixedly attached between the table input plate 290 and the spanner plate 297 and laterally spaced between the right hand pulley mount assembly 278 and the right corner block 291. The left hand spacer block 299 is similarly attached and placed on the left side of the machine. It is to be noted that the leading edge of the table input plate 290 is provided with a series of seven slots 305. The center slot of the series cooperates with the clear space between the right and left hand pulley mount assemblies 278 and 280, respectively. The two slots immediately adjacent either side of the center slot cooperate with the clear spaces between the right and left hand roller plates 282 and 286 of the right and left hand pulley mount assemblies 278 and 280, respectively. In this manner, space is provided for the entry of the set of fingers 58 (FIG. 13) of the extraction assembly 28.

The set of bottom belts 52 (FIG. 6) passes counterclockwise about the fourth set of top pulleys 274 to return to the set of back pulleys 273. Each member of the set of back pulleys 273 is rotatably mounted upon a ball bearing that is in turn mounted upon a stationary cantilever shaft similar to the shafts of the sets of upper pulleys 273, 271, 272 and 274. The set of bottom belts 52 passes in a clockwise direction around the set of back pulleys 273 to descend to the fourth drive pulley 259. Passing counterclockwise about the fourth drive pulley 259, the set of bottom bolts 52 passes clockwise about the takeup roller 275 before returning to the bottom input roller 267.

The set of bottom belts 52 is tensioned by the takeup roller 275 (FIGS. 6 and 14) that is in turn rotatably mounted by ball bearings upon a shaft 302. The shaft 302 is restrained in place by chains 304 that are fixedly attached to the extremities thereof by shoulder bolts 306. The chains 304 pass upwardly and in the output direction to partially circumscribe sprockets 308. Last links of the chains 304 and the hub of the sprocket itself can be modified slightly to permit fixed attachment of the chains to the sprocket wheels. The sprockets 308 are fixedly attached to a torque bar 310 that extends to the left and right far enough to pass through and be supported by holes in the right and left side plates 67 and 69, respectively. A torque arm 312 is fixedly attached near each end of the torque bar 310 that is employed to wind up the chains upon their sprockets thereby pulling tension into the set of bottom belts 52. As the torque arms 312 are rotated counterclockwise, their free ends come to predrilled holes 316 in the side plates 67 and 69, which are employed to fasten the torque arms 312 in place. A spacer block 314 is rigidly affixed to the lower outboard surfaces of each of the torque arms 312 to provide lateral displacement of the arms on the torque bar 310 and clearance for the output ends of the pair of incline radius arms 277.

Upper Belts

Figure 17:
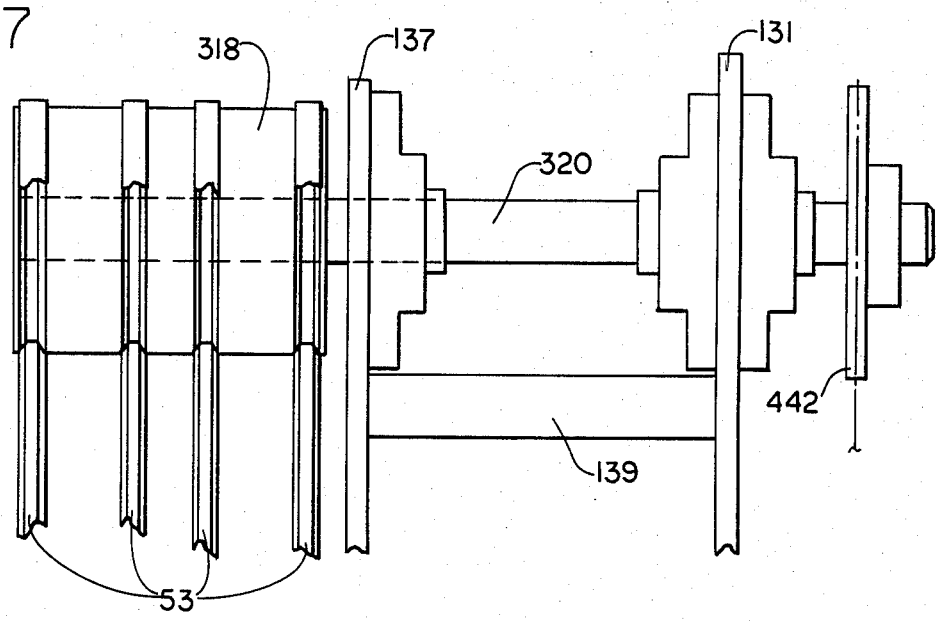
FIG. 17 is a fragmentary view on an enlarged scale looking in the direction of the arrows 17—17 in FIG. 6.
Figure 18:
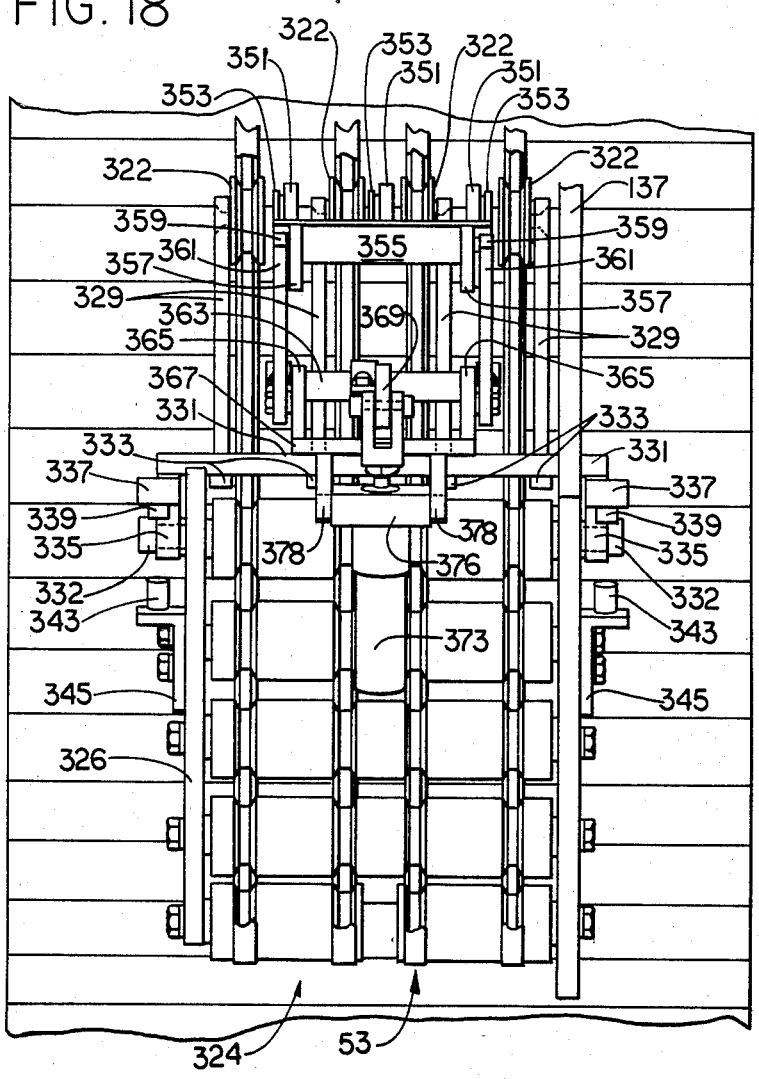
FIG. 18 is a fragmentary view looking in the direction of the arrows 18—18 in FIG. 6.

The set of top belts 53 of the paired incline belts 18 is motivated in clockwise rotation by a fifth drive roller 318 that is fixedly attached to a fifth drive shaft 320 (FIGS. 6, 17 and 18). The roller 318 is mounted on the cantilever left end of the fifth drive shaft 320 that in turn extends to the right through supporting bearings in a manner similar to what has been previously discussed for the third drive roller 218.

The set of top belts 53 circumscribes a set of pressure wheels 322 and a curvilinear set of rollers 324. Each member of the curvilinear set of rollers 324 is similar in construction to the rollers of the set of four contour rollers 232 of the upper set of feed belts 48. All the rollers in these two sets are located on the same arc, and as such provide a smooth transition for the shingle of cartons 38 from the horizontal to the vertical position. The right extremities of the bearing shafts of the curvilinear set of rollers 324 are fixedly attached in spaced relationship to the left surface of the belt plate 137, again in the same way as the set of four contour rollers 232. The left hand extremities are similarly held in fixed relationship with each other by means of an upper partial belt plate 326.

The set of pressure wheels 322 is ball bearing mounted upon static shafts that are in turn fixedly attached in cantilever manner to the inboard surfaces of a set of extension arms 329. The lower extremities of the extension arms 329 are fixedly attached to the top surface of a lateral bar 331 by means of screws 333 that pass through four clear holes in the lateral bar 331 and threadably mount in the bottoms of the arms 329. The lateral placement of the extension arms 329 is such so as to place the set of pressure wheels 322 into rolling contact with the set of top belts 53.

A pivot lug 335 is rigidly affixed at each end of the lateral bar 331 and extends downwardly to be pivotally mounted upon the shoulders of bolts 332 that fixedly attach the bearing shaft of the upper roller of the curvilinear set of rollers 324 between the upper partial belt plate 326 and the belt plate 137. A torque arm 337 is rigidly affixed to the input face of each pivot lug 335 and extends in the input direction therefrom. A downwardly facing pin 339 is rigidly affixed into the bottom input surface of each torque arm 337 and functions as a spring retainer for a compression spring 341. The compression spring 341 extends downwardly and is retained by a second pin 343, that is in turn rigidly affixed into the top surface of a laterally disposed leg of an angle bracket 345. The angle bracket 345 incorporates a vertical slot 347 which provides for fixed but adjustable attachment to the outboard surfaces of the belt plate 137 and the upper partial belt plate 326. The compression springs 345 provide a counterclockwise torque urging the set of pressure wheels 322 and the local segment of the set of top belts 53 against the face of the shingle of cartons 38 as it exits the paired incline belts 18. As the end of the shingle of cartons 38 advances upwardly toward the table assembly 24, the local segment of the set of top belts 53 moves toward the upper portion of the set of bottom belts 52 that pass about the first set of top pulleys 269, narrowing the gap therebetween and moving the last cartons in the shingle 38 toward the slug 54 as far as possible. It is not possible for the foregoing mechanism to assure that the bottom edges of the last cartons in the slug 54 are motivated up and over the first set of top pulleys 269. This is accomplished by a pusher wheel assembly 349 that incorporates three pusher wheels 351 as is shown also in FIGS. 6 and 18. The pusher wheels 351 incorporate ball bearings mounted on fixed cantilever shafts that are in turn fixedly attached through the output ends of wheel arms 353. The wheel arms are disposed mostly horizontal, being rigidly affixed at their input extremities to the output face of a lateral bar 355. The wheel arms are laterally disposed upon the lateral bar 355 to position the pusher wheels 351 in the clear spaces between the set of pressure wheels 322. Mounting lugs 357 are rigidly affixed to the input surface of, and approximate the ends of the lateral bar 355. The mounting lugs 357 are pivotally mounted to the upper ends of a pair of output links 359 and a pair of input links 361. The lower extremities of the output links 359 are fixedly clamped upon the ends of a torque bar 363. The torque bar 363 is pivotally mounted through two pivot plates 365. The pivot plates 365 are rigidly affixed in spaced and upright orientation upon the upper surface of a pusher mount plate 367 that is in turn rigidly affixed in cantilever form and extending in the input direction to the upper surface of the lateral bar 331. The lower ends of the input links 361 are pivotally mounted upon short cantilever shafts that extend outboardly from the pair of pivot plates 365 to complete a parallelogram assembly that permits the pusher wheels 351 to move longitudinally in a largely horizontal plane. The parallelogram assembly is moved and controlled by a torque arm 369 that is clampedly attached to the middle of the torque bar 363. Extending horizontally in the input direction, the free end of the torque arm 369 is pivotally mounted in a cylinder yoke 371 that is in turn threadably and fixedly attached to the working extremity of a cylinder rod of a cylinder 373. The cylinder 373 is threadably and fixedly mounted into a trunnion mount 376 that is in turn pivotally mounted in a pair of cylinder hangers 378. The pair of cylinder hangers 378 is spacedly and rigidly affixed to the underside of the pusher mount plate 367 to cooperate with the width of the trunnion mount 376. As the cylinder 373 extends, the torque arm 369 is pivoted counterclockwise, motivating the parallelogram assembly in the same direction, which consequently moves the pusher wheels 351 in the output direction. As the cylinder 373 extends to full stroke, the pusher wheels move to a point almost directly above the set of fingers 58 of the extraction assembly 28 assuring that the last cartons in the slug of cartons 54 move upwardly over the first set of top pulleys 269. Since the set of bottom belts 52 protrude slightly from the sets of top pulleys 269, 271, 272 and 274, the belts 52 will frictionally move the bottom edges of the last cartons of the slug of cartons 54 in the output direction to a point beyond the set of fingers 58 of the extraction assembly 28. Operation of the extraction assembly 28 is now possible without the risk of jamming the set of fingers 58 into the last few cartons of the slug of cartons 38.

Drive Assembly

The hopper belt 37, the paired feed belts 14 and the paired incline belts 18 receive power from a hydraulic motor 352, as is shown most completely in FIGS. 5 and 7. The belts are controlled in speed by the clutch 50 and the motor 352, which is a two-speed device. The fluid system controlling the motor 352 contains flow control valves so that the two speeds available from the motor 352 are adjustable. The clutch 50 and a transfer shaft assembly 354 (FIGS. 5 and 7) are mounted upon a sub-frame 356. The sub-frame 356 is comprised of a pair of hanger plates 358L and 358R, a first transverse member 360, a second transverse member 362, a right side longitudinal member 364 and a left side longitudinal member 366. The right side hanger plate 358R is a rectangular plate that is vertically disposed and fixedly attached to the inboard surface of the right side plate 67 approximate the input end of the slug accumulator 10. Likewise, the left side hanger plate 358L is fixedly attached to the inboard side of the left side plate 69. Both hanger plates 358L and 358R extend downwardly below the side plates 67 and 69 as is shown best in FIG. 5. The first transverse member 360 is rigidly affixed at its extremities between the pair of hanger plates 358 at lower input corners thereof. The second transverse member 362 is also rigidly affixed between the pair of hanger plates 358, but located at lower output corners thereof. The right side longitudinal member 364 is rigidly affixed at its extremities between the first and second transverse members 360 and 362, respectively, and located somewhat to the right of the centerline of the slug accumulator 10. The left side longitudinal member 366 is rigidly affixed between the first and second transverse members 360 and 362, respectively, and located somewhat to the left of the centerline of the slug accumulator 10. A clutch plate 368 is rigidly affixed upon the top of the sub-frame 356, overlying the intersection of the first transverse member 360 and the right side longitudinal member 364. A left side plate 370 is rigidly affixed to the top surface of the subframe 356 and overlies the intersection of the second transverse member 362 and the left side longitudinal member 366. A right side plate 372 is rigidly affixed across the top surface of the second transverse member 362 and is located slightly to the right of the right side longitudinal member 364.

The transverse shaft assembly 354 is comprised of a transfer shaft 375 that is rotatably mounted in a pair of bearings 377 and a right side bearing 379. The pair of bearings 377 is adjustably and spacedly mounted upon the top surface of the left side plate 370. The inboard bearing of the pair is centrally located upon the left side plate 370 to cooperate with a jack screw 381. The right side bearing 379 is likewise adjustably mounted upon the top surface of and along the outboard edge of the right side plate 372. The input extremity of the right side bearing 379 cooperates with a second jack screw 383. The left end of the transfer shaft 375 fixedly accommodates a motor transfer sprocket 385. A clutch transfer sprocket 387 is fixedly attached to the transfer shaft 375 just inboardly of the pair of bearings 377. The right end of the transfer shaft 375 fixedly accommodates an incline power sprocket 389.

The clutch 50 is fixedly attached to the upper surface of the clutch plate 368. Its input shaft extends to the left and fixedly accommodates a clutch input sprocket 391. The output shaft of the clutch 50 extends to the right and fixedly accommodates a feed power sprocket 393. A clutch chain 395 circumscribes the clutch transfer sprocket 387 and the clutch input sprocket 391 and is properly tensioned by adjustment of the jack screw 381 and the second jack screw 383 of the transfer shaft assembly 354.

The hydraulic motor 352 (FIG. 7) is fixedly mounted upon the outboard surface of, and adjacent the input end of the left side plate 69. A motor shaft 396 of the hydraulic motor 352 extends to the right through the side plate 69 to fixedly accommodate a motor sprocket 398. A power chain 402 circumscribes the motor transfer sprocket 385 and the motor sprocket 398 and is properly tensioned by an idler sprocket assembly 404 that is in turn adjustably attached to the inboard surface of the left side plate 69. In this manner, rotational power is transferred from the hydraulic motor 352 to the transfer shaft assembly 354.

The transfer shaft assembly 354 transfers power to the clutch 50 through the clutch chain 395. Since the internal mechanism of the clutch 50 is either engaged or disengaged, power is supplied to the feed power sprocket 393 only on demand. Continuous power is supplied to the incline power sprocket 389 from the transfer shaft assembly 354.

Power is supplied to the hopper belt 37 and the paired feed belts 14 through the feed power sprocket 393 of the clutch 50. A hopper chain 406 circumscribes the feed power sprocket 393 and a first drive sprocket 408 that is fixedly attached to the first drive shaft 158 just inboard of the right side plate 67. The hopper chain 406 is properly tensioned by a second idler sprocket assembly 410 that is in turn adjustably attached to the inboard surface of the right side plate 67. The first drive shaft 158 drives the hopper belt 37 as previously described and transfers power to a feed belt sprocket 412 that is fixedly attached to the right end of the first drive shaft 158.

Now referring to FIG. 16, the feed belt sprocket 412 transfer power to a feed belt chain 414. The feed belt chain 414 passes clockwise around and from the feed belt sprocket 412 to pass upwardly and in the output direction to pass counterclockwise about a third drive sprocket 416 that is in turn fixedly attached upon the right end of the third drive shaft 220. The third drive shaft 220 drives the upper set of feed belts 48 (FIG. 6) as previously described. The feed belt chain 414 passes upward and clockwise about a fixed idler sprocket 418, then downwardly and in the output direction to pass clockwise about a third idler sprocket assembly 420. The third idler sprocket assembly 420 is adjustably attached to the outboard surface of the right side plate 67 and is employed to properly tension the feed belt chain 414. The feed belt chain 414 passes from the third idler sprocket assembly 420 toward the input end of the slug accumulator 10 to pass counterclockwise about a second fixed idler sprocket 422. Passing downwardly therefrom, the feed belt chain 414 passes clockwise around a second drive sprocket 424 and completes the circuit at the feed belt sprocket 412. The second drive sprocket 424 is fixedly attached to the right end of the second drive shaft 179 that in turn motivates the lower feed belt 46. As can be seen then in FIG. 16, the hopper belt 37 and the lower feed belt 46 travel clockwise, while the upper set of feed belts 48 travels counterclockwise. All three belt systems travel at the same surface velocity to produce and transport the shingle of cartons 38 to the counter assembly 16. The clutch 50 is used to stop these belts, while the hydraulic motor is used to run them at either high or low speed. Output ends of the belts 46 and 48 form an article stop station.

Referring to the upper central portion of FIG. 7 and to FIG. 6, the incline power sprocket 389 delivers power to a fourth drive sprocket 426 by means of an incline power chain 428. The fourth drive sprocket 426 is fixedly attached upon the fourth drive shaft 261 just inboard of the right side plate 67. The incline power chain 428 as shown in FIGS. 5 and 6, circumscribes the incline power sprocket 389 (hidden from view), the fourth drive sprocket 426 and a fixed idler sprocket 432. The fixed idler sprocket 432 is attached to the inboard surface of the right side plate 67 adjacent the first lateral member 75 to facilitate the passage of the lower portion of the incline power chain 428 from the fourth drive sprocket 432 to the incline power sprocket 389. The incline power chain 428 is properly tensioned by a fourth idler sprocket assembly 430 that is in turn adjustably attached to the inboard surface of the right side plate 67.

Again referring to FIG. 16, power is transferred outboardly through the fourth drive shaft 261 to an incline sprocket 434 that is fixedly attached to the right end thereof. The incline sprocket 434 rotates clockwise, passing an incline chain 436 in the input direction to pass counterclockwise about a fifth idler sprocket assembly 438. The idler sprocket assembly 438 is adjustably mounted to the outboard surface of the right side plate 67 just below and somewhat to the input side of the incline sprocket 434. The incline chain 436 passes horizontally in the output direction to pass counterclockwise about a fixed idler 440, from which it rises nearly vertically to pass counterclockwise about an incline belt sprocket 442. The incline chain 436 then descends vertically to complete the circuit at the incline sprocket 434 and is properly tensioned by the fifth idler sprocket assembly 438. The incline belt sprocket 442 (FIG. 17) is fixedly attached to the right end of the fifth drive shaft 320 to impart motion to the set of top belts 53 of the pair of incline belts 18. The output segment of the set of top belts 53 therefore rises upwardly as does the adjacent segment of the set of bottom belts 52, to transport the shingle of cartons 38 from the counter assembly 16 to the table assembly 24. These belts run continuously, such that when the counter assembly 16 reaches the proper number of cartons to be inserted into the slug of cartons 54, the feed belts are stopped by the clutch 50, enabling the counted cartons to proceed to the table assembly 24. The paired incline belts 18 run at the same surface speed as the paired feed belts 14.

Upper Stop Assembly

The upper stop assembly 22 (FIG. 1) is comprised of an adjustable frame 445, a slide assembly 447, an upper backstop 449 (FIG. 23) and an overhead stop assembly 451, as is shown compositely in FIG. 1.

Figure 11:
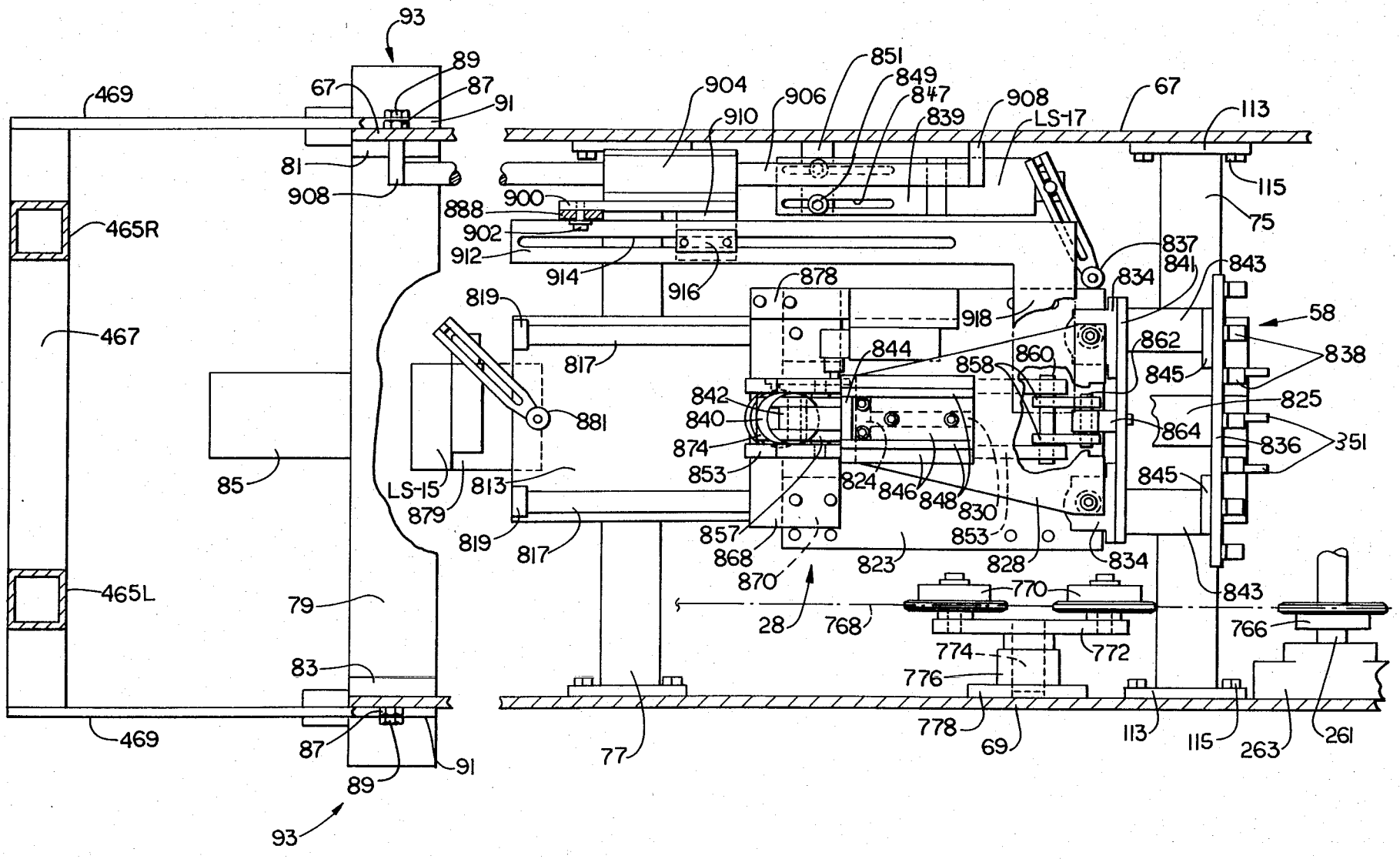
FIG. 11 is a fragmentary view in horizontal section of the machine on an enlarged scale.
Figure 21:
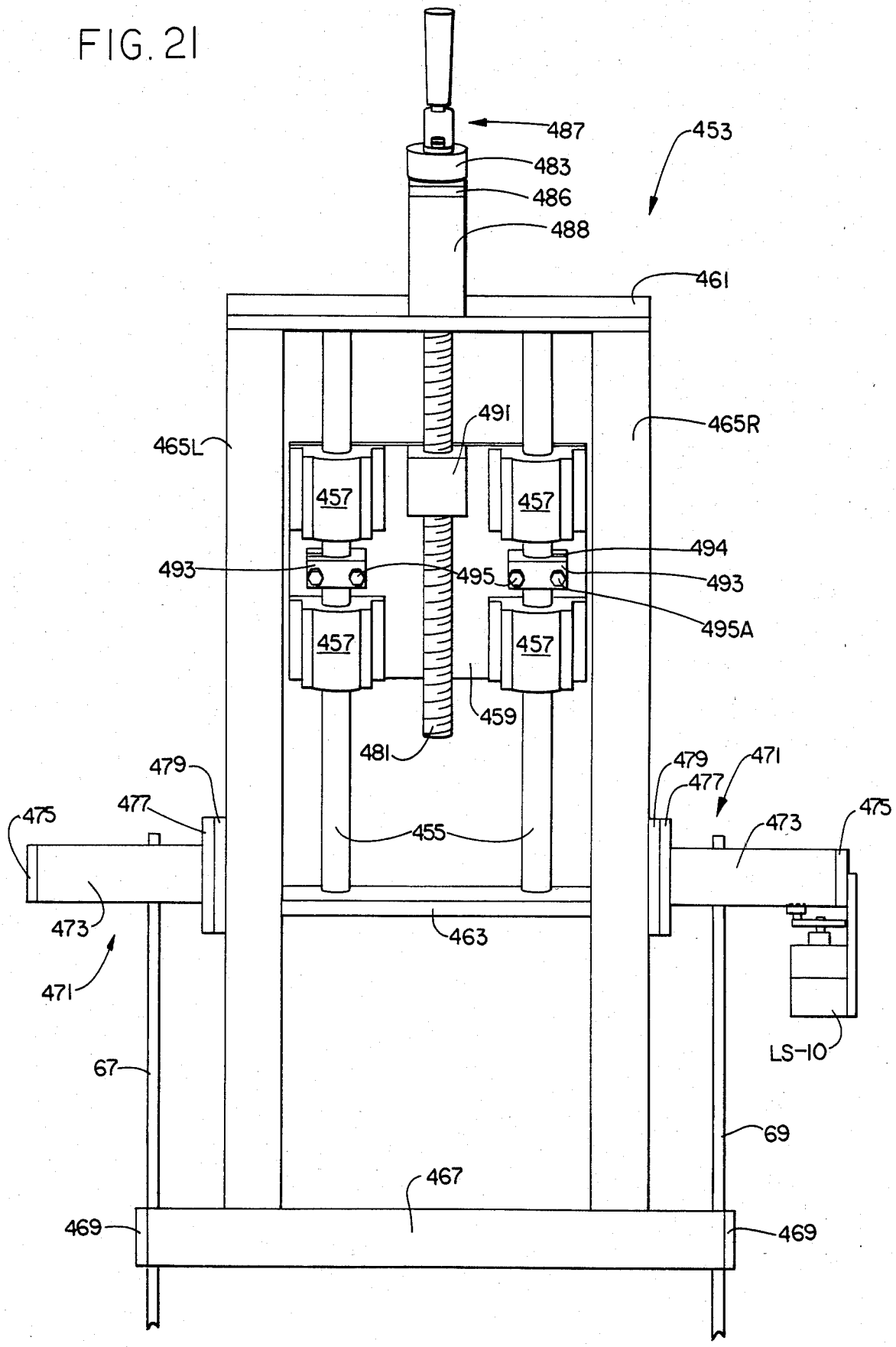
FIG. 21 is a fragmentary view in end elevation on an enlarged scale of the machine.

The adjustable frame 445 is vertically adjustable by means of a vertical slide assembly 453 that is shown in detail in FIGS. 9, 10 and 21. The vertical slide assembly 453 incorporates a pair of bars 455 that cooperate with a set of four bearing blocks 457. The set of four bearing blocks 457 is fixedly attached in spaced arrangement at the corners of, and upon the output surface of a mount plate 459. The pair of bars 455 is fixedly attached in slanted orientation between an upper plate 461 and a lower plate 463. The upper plate 461 is fixedly attached across the top surfaces of end caps 464 that are in turn rigidly affixed across the upper canted extremities of output posts 465L and 465R. The lower plate 463 is also rigidly affixed between the output posts 465L and 465R at a height just below the main plate 123 of the table assembly 24. The bottom extremities of the output posts 465L and 465R are rigidly affixed upon the top surface of an output auxiliary bar 467 that is in turn rigidly affixed between the output ends of a pair of cantilever plates 469 as is shown in FIG. 11. The input ends of the pair of cantilever plates 469 are fixedly attached to the outboard surfaces of the right and left side plates 67 and 69, respectively, and above the lower output frame 71. Vertical stability of the ouput posts 465L and 465R is assured by outboard braces 471. Each outboard brace 471 is comprised of a short tube 473, a longitudinal plate 475 and a flange plate 477. The flange plate 477 is rigidly affixed to the inboard extremity of the short tube 473, and the longitudinal plate 475 is rigidly affixed to the outboard extremity thereof and extends in the input direction. The flange plates 477 are fixedly attached to the outboard surfaces of the output posts 465L and 465R by means of mount pads 479. The input ends of the longitudinal plates 475 are fixedly attached to the outboard surface of the frame structure of the side pusher assembly 30, as will be discussed hereinafter.

The vertical slide assembly 453 is placed and maintained in vertical position by a screw 481. The upper end of the screw 481 integrally incorporates a bearing diameter 482. The upper portion of the bearing diameter 482 rigidly incorporates a thrust block 483 that in turn fixedly acommodates a handle 487. The thrust block 483 bears down upon a thrust washer 485 while the bearing diameter 482 is rotatably located in a bore 484 of a cap plate 486. The cap plate 486 is rigidly affixed upon the top extremity of a standoff tube 488 that is in turn rigidly affixed upon the top of, and at the center output edge of the upper plate 461. The threaded portion of the screw 481 passes downwardly through a clear hole 490 in the upper plate 461 to threadably cooperate with a block 491 that is in turn fixedly attached to the upper output surface of the mount plate 459.

In order to prevent inadvertent movement of the vertical slide assembly 453 due to vibration and the massiveness of the upper stop assembly 22, the vertical slide assembly 453 can be locked in place by clamp blocks 493. The clamp blocks 493 each exhibit a smooth bore to cooperate with the bars 455 and a slot 494 opening from the side of the block into the bore. Screws 495 pass through clear holes in each clamp block and threadably mount into the mount plate 459. One of the screws 495A cooperates with the slot 494 to collapse the bore of the associated clamp block 493A around the associated rod 455 (see FIG. 10A).

A cantilever frame 497 (FIGS. 10, 22–25) is fixedly attached to the input surface of the mount plate 459 and is comprised of a left frame member 498, a right frame member 502, a rear lateral brace 504, a right hand standoff 506, a left hand standoff 508, and an input brace 510. The output extremity of the left and right frame members 498 and 502, respectively, are spacedly and rigidly attached along the vertical edges of and to the input surface of the mount plate 459 (FIG. 10). These two members are stabilized in parallel alignment by the rear lateral brace 504 and the input brace 510. The rear lateral brace 504 is fixedly mounted near the output end of the cantilever frame 497. The input brace 510 rigidly incorporates mounting pads 512 upon its outboard extremities and extending in the output direction. The mounting pads 512 are each provided with a pair of threaded holes to accommodate fixed attachment to the right and left frame members 502 and 498, respectively, by screws 514.

The slide assembly 447 (FIGS. 23–25) rides upon a pair of rods 513 that is horizontally and fixedly attached between the rear lateral brace 504 and the right and left hand standoffs 506 and 508, respectively. The pair of rods 513 cooperate with a pair of long bearings 515 that is in turn spacedly and fixedly attached to the underside of a carriage plate 517. The right side of the carriage plate 517 extends somewhat outboardly for attachment of a drive chain 519 and to function as a limit switch trip. The output edge of the carriage plate 517 integrally incorporates a cylinder mount extension 521.

The slide assembly 447 is motivated longitudinally by a hydraulic motor 525 that is fixedly attached to a vertically adjustable spanner plate 526. The spanner plate 526 is fixedly and adjustably attached to a pair of upright bars 528 by four bolts 530. The bolts 530 pass through a pair of clear holes in each of two clamp plates 532, through corresponding slots 534 and 536 along the edges of the spanner plate 526 and threadably mount into the inboard face of the pair of upright bars 528. Jack screw mounts 538 are rigidly affixed at the top corners of, and extend outboardly from, the spanner plate 526. Each jack screw mount 538 threadably accommodates a vertically disposed jack screw 540 which bears downwardly upon the top extremity of the pair of upright bars 528 providing a controlled method for setting chain tension of a motor chain 558. The bottom extremity of the pair of upright bars 528 is rigidly affixed to a motor base 542 and is rigidized in vertical disposition by a pair of gussets 544, rigidly affixed therebetween. The motor base 542 is rigidly affixed to the top edges of a pair of standoff members 546. The standoff members 546 are rigidly affixed in spaced and parallel relationship to vertical edges of an attachment plate 548. The attachment plate 548 is fixedly attached to the outboard surface of, and adjacent the output end of the right frame member 502.

A pair of transfer bearing blocks 550 is fixedly attached to the top surface of the motor base 542 and rotatably hold in transverse orientation a transfer shaft 552. The inboard portion of the transfer shaft 552 fixedly incorporates a large sprocket 554, as well as a small sprocket 556, fixedly attached to the inboard extremity thereof. The motor chain 558 passes around the circumference of the large sprocket 554 to rise upwardly from each side thereof to pass around the upper circumference of a smaller motor sprocket 560. The motor sprocket 560 is fixedly attached to the output shaft of the hydraulic motor 525. The speed of the hydraulic motor 525 is thereby stepped down to the transfer shaft 552 to match the requirements of the slide assembly 447. The drive chain 519 passes around the smaller sprocket 556 of the transfer shaft 552 and an idler sprocket 562 that is in turn rotatably mounted from the upper outboard surfaces of an idler mount 564. The idler mount 564 places the idler sprocket 562 in lateral line with the small sprocket 556, and is adjustably mounted in longitudinal placement near the input end of the right frame member 502. Two bolts 566 pass through a horizontal slot 568 in the right frame member 502 to threadably mount into the lower outboard surface of the idler mount 564. The drive chain 519 is properly tensioned with the aid of a jam screw 570 that is threadably mounted through the upper portion of the right hand standoff to bear against the output surface of the idler mount 564.

A resilient stop 571 is threadably mounted into the output face of each of the right and left hand standoffs 506 and 508, respectively, just above the pair of rods 513 so as to cooperate with the input edge of the carriage plate 517. A shock absorber 573 is utilized to decelerate the slide assembly 447 before it comes to rest against the resilient stops 571. The shock absorber 573 is fixedly mounted through an upright plate 575 that is in turn rigidly affixed to the upper input edge of a base member 577 carried by the carriage plate 517. The right angle relationship between the upright plate 575 and the base member 577 is strengthened by gussets 579 rigidly affixed to each side thereof. The shock absorber mount is fixedly attached upon the top surface of and in longitudinal line with the right hand member of the pair of slide rods 513, such that the working plunger of the shock absorber 573 comes into proper contact with the upper output surface of the right hand standoff 506. Travel of the slide assembly 447 in the output direction is controlled by limit switches as will be discussed hereinafter.

The upper backstop assembly 449 (FIGS. 23 and 24) incorporates a nonrotatable bar 580 that is clampedly held through the lower ends of a pair of hanger bars 582. The hanger bars 582 rise vertically to be rigidly affixed to the bottom input surfaces of a pair of cantilever plates 584. The cantilever plates 584 are fixedly attached at their output ends to the top central input surface of the carriage plate 517. The hanger bars 582 are laterally spaced upon the bar 580 to accommodate a pair of holdback arms 586 pivotally therebetween. The holdback arms 586 are rigidly held in spaced and parallel relationship by an input spacer 588 and an output spacer 590. A pivot bar 592 passes laterally through bushings in the input end of the pair of holdback arms 586 and fixedly incorporates a set of three right angle clamps 594, one on the left side, one in the middle of, and one on the right side of the pair of holdback arms 586. When the pair of holdback arms 586 is in the horizontal position, the set of three right angle clamps 594 adjustably and fixedly hold a set of three rods 596 in vertical disposition and extending downwardly in front of the advancing slug of cartons 54 that is entering the table assembly 24. The right hand end of the pivot bar 592 fixedly incorporates a pivot sprocket 598 that in turn communicates with a stationary sprocket 600 by means of a chain 602. The stationary sprocket 600 is fixedly attached to the right hand end of the non-rotating bar 580. A holdback cylinder 604 is pivotally mounted at its base to a clevis bracket 606 that is in turn fixedly attached to the bottom output surface of the cylinder mount extension 521 of the carriage plate 517. A cylinder rod 607 of the cylinder 604 is clevis mounted to a center lug 608 that is in turn rigidly affixed in upright disposition to the top surface of output spacer 590 of the pair of holdback arms 586. As the holdback cylinder 604 retracts, the pair of holdback arms 586 pivot counterclockwise to a mostly vertical position where the input spacer 588 comes into contact with a resilient stop 610. The resilient stop 610 is threadably mounted into the vertical flange of an angle bracket 612, the horizontal flange thereof being fixedly attached upon the top surface of the carriage plate 517 between the pair of cantilever plates 584. It is to be noted that as the pair of holdback arms 586 pivots counterclockwise, the stationary sprocket 600 remains fixed, causing the pivot sprocket 598 to remain pivotally fixed in relation to the slug accumulator 10. Therefore, the set of three rods 596 remain vertical as they are raised upwardly and rearwardly away from the advancing slug of cartons 54.

The overhead stop assembly 451 is comprised of an input mount 615, a rear support 617, and a pair of rails 619. The input mount 615 incorporates a pair of guide members 621 and a spacer block 623. Recesses 625 are provided in the output portions of the inboard surfaces of the pair of guide members 621 to provide flush alignment of the inboard surfaces of the pairs of rails and guide members 619 and 621, respectively. The rails and guide members 619 and 621 are fixedly attached by transverse screws 622 passing through counterbored holes in the guide members 61 to threadably mount into the input ends of the rails 619. Deep recesses 627 are provided in the input portions of the inboard surfaces of the pair of guide members 621 to provide for free passage of the two inner belts of the set of top belts 53 of the paired incline belts 18. Rollers 624 (FIG. 24) rotatably guide the two inner belts of the top belts 53 as they run in the recesses 627. The rollers 624 are rotatably mounted on a shaft 626 carried by an arm 628. The arm 628 is attached to the input brace 510. The spacer block 623 is rigidly affixed between the guide members 621 providing spaced and parallel alignment therebetween. The input surface of the spacer block 623 is in lateral plane with the input extremity of the pair of guide members 621, and the output extremity thereof extends rearward past the deep recesses 627. The input mount 615 is fixedly attached to mounting feet 629. The mounting feet 629 are rigidly affixed at their input extremities to the lower output surface of the input brace 510. A resilient bumper 631 is threadably mounted into the top surface of the right hand member of the pair of guide members 621 to function as a down stop for the pair of holdback arms 586 of the upper backstop assembly 449.

The rails 619 are rigidly held in spaced and parallel alignment by an output spacer 633 that is in turn fixedly attached to the bottom surface of, and at the center of, the rear support 617. The rear support 617 incorporates a lateral member 635 whose upper outboard surfaces are fixedly attached to the bottom extremities of hangers 637. The hangers 637 are fixedly attached to the inboard surfaces of the right and left frame members 502 and 498. The overhead stop assembly 451 presents an overhead restraint to the slug of cartons 54 while the slug is forming and being moved upon the table assembly 24.

Figure 22:
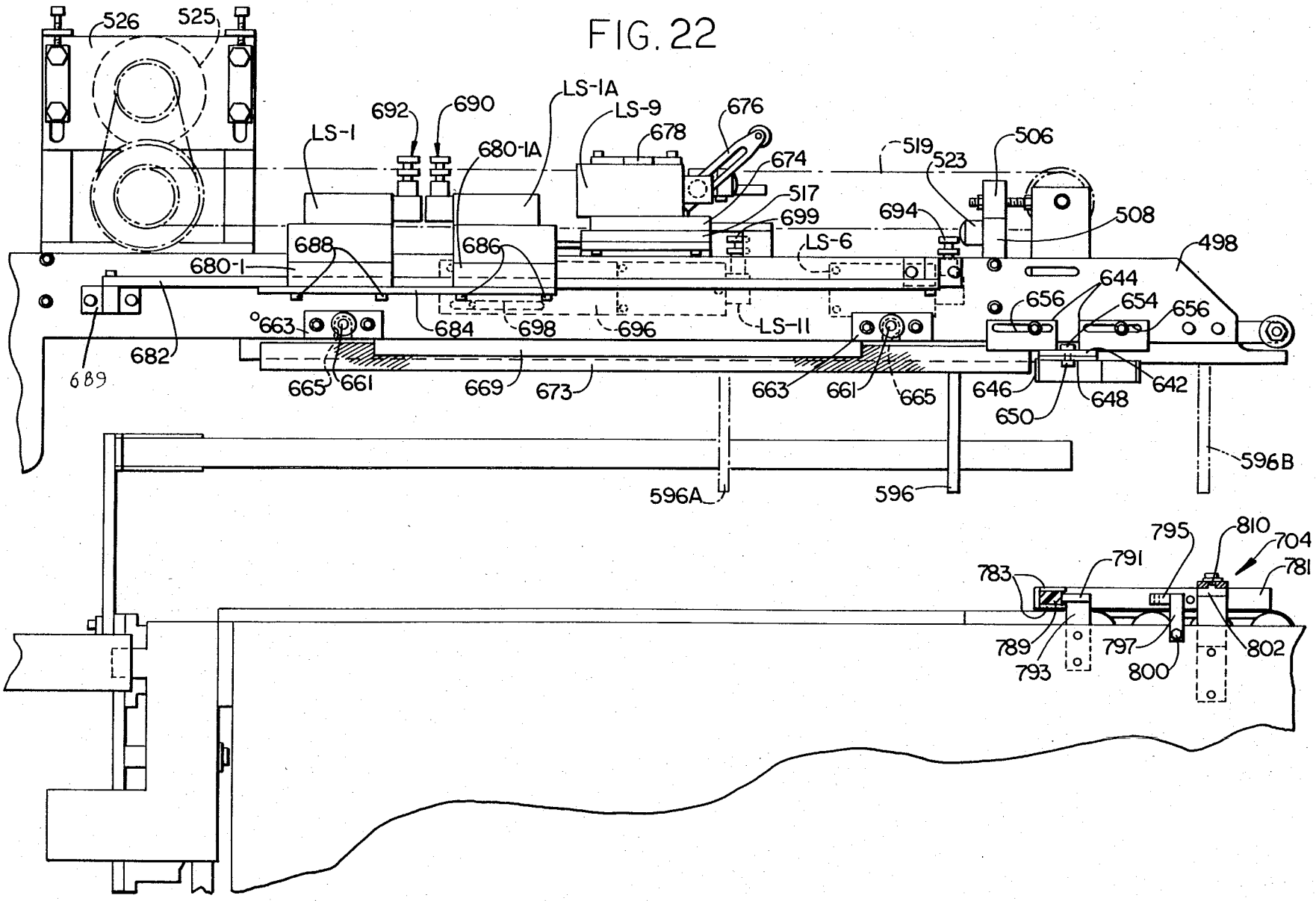
FIG. 22 is a fragmentary view partly in side elevation and partly in section of the machine, alternate portions of an upper back-stop member being shown in dot-dash lines.
Figure 24:
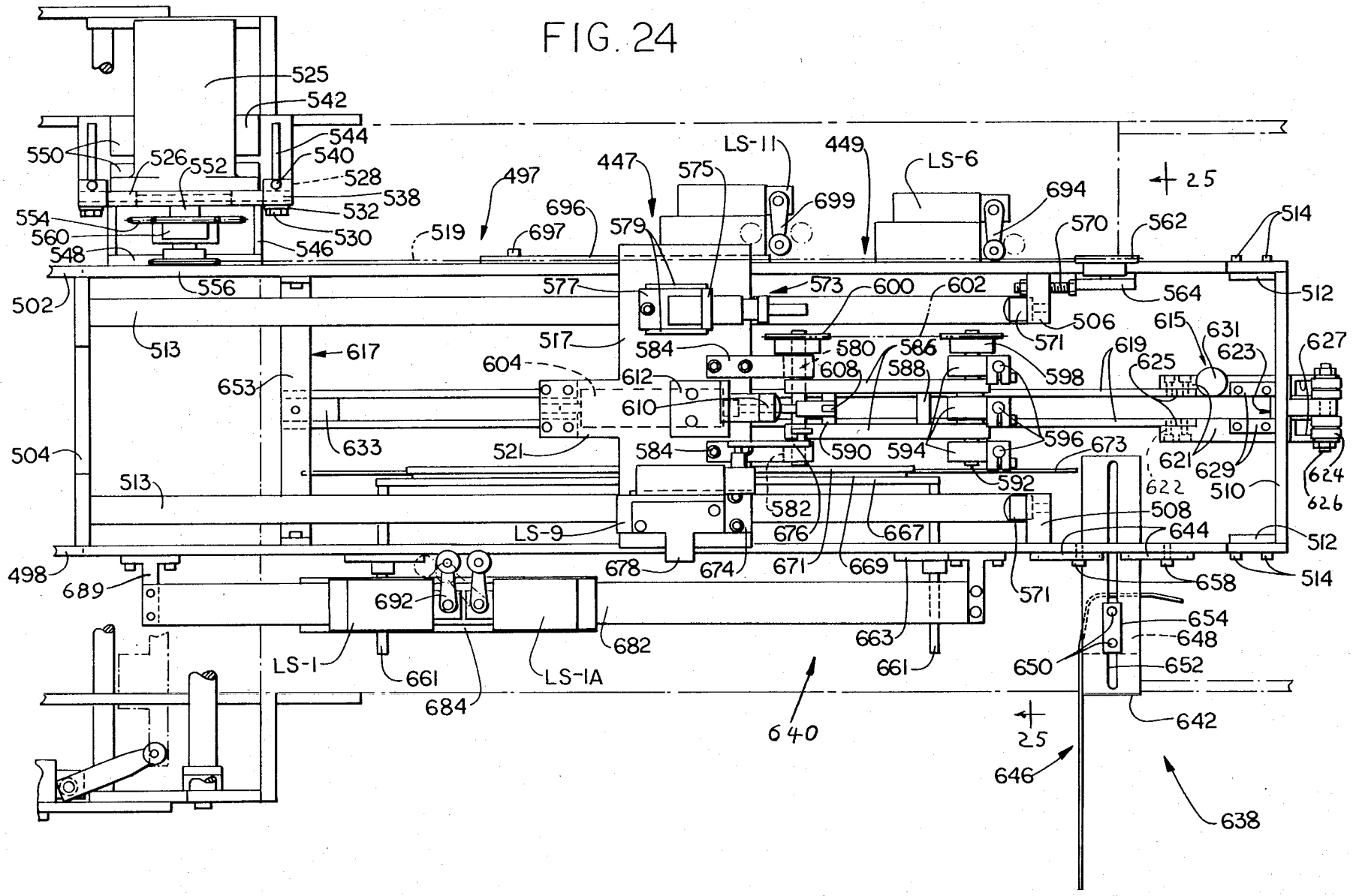
FIG. 24 is a fragmentary plan view of the machine on an enlarged scale.
Figure 25:
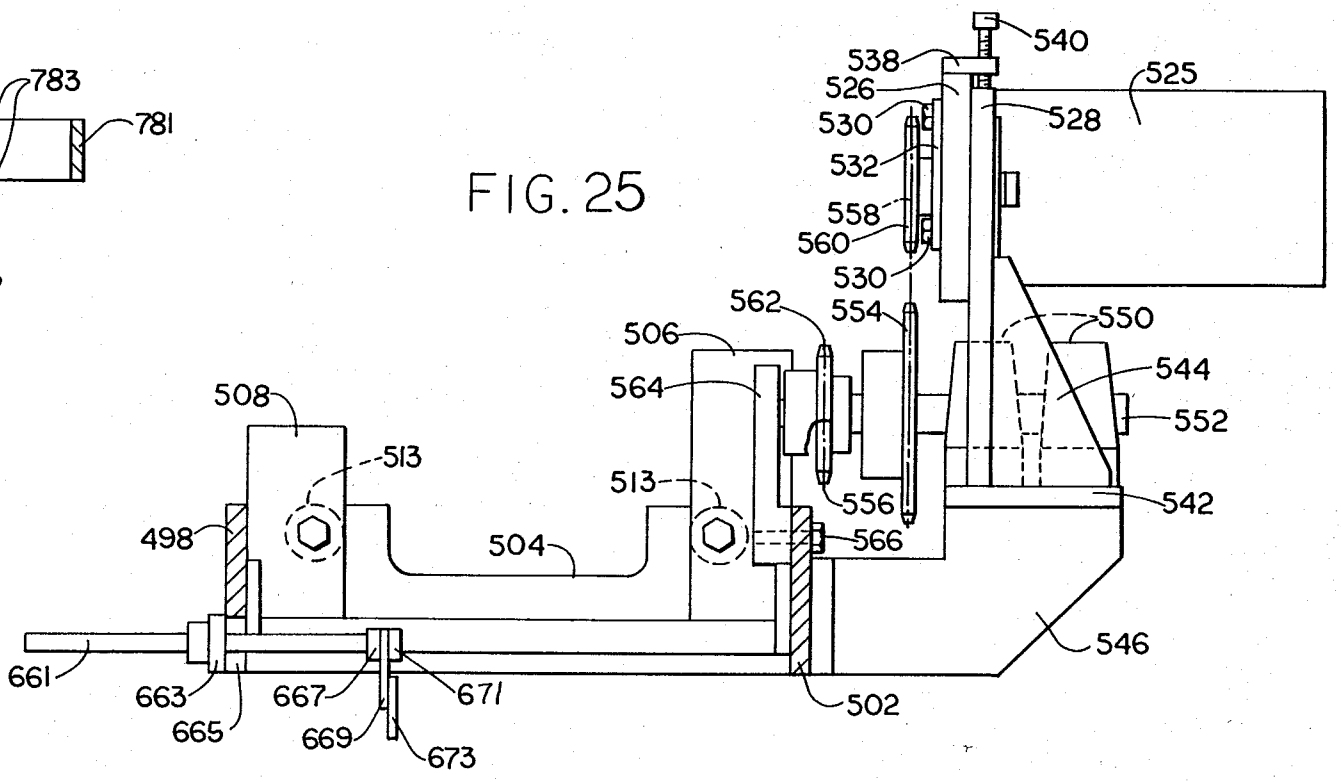
FIG. 25 is a fragmentary view in transverse section taken generally on the line 25—25 in FIG. 24.

Overhead guides for the slug of cartons 54 include a corner guide assembly 638 and a slug gate assembly 640 as is best shown in FIGS. 22, 24 and 25. The corner guide assembly 638 incorporates a lateral plate 642, mount plates 644, and a corner guide 646. The corner guide 646 is a long narrow strip of metal that is rigidly affixed along its upper edge to the inboard and output edges of a former plate 648 to produce an L-shaped guide whose shorter longitudinal leg is angled outwardly to facilitate the entry of the slug of cartons 54, and whose lateral leg extends considerably outboard to hold the exiting slug of cartons 54 in upright disposition until it has fully entered the output assembly not shown. Bolts 650 pass upwardly through clear holes in the former plate 648, through a long slot 652 in the lateral plate 642, and threadably mount into a nut plate 654. The mount plates 644 are rigidly affixed in upright orientation, across the middle top surface of the lateral plate 642. The two mount plates 644 are sufficiently spaced apart so as to permit the nut plate 654 to pass therebetween. A slot 656 is provided along the upper edge of each mount plate 644. Two bolts 658 pass through the slots 656 to threadably mount into the left frame member 498 at such a height to permit the nut plate 644 to pass under the left frame member 498 and yet keep the top edge of the corner guide 646 above the bottom edges of the overhead stop assembly 451.

Ample longitudinal adjustment is provided by the slots 656 and considerable transverse adjustment is provided by the long slot 652. The considerable transverse adjustment is needed to cooperate with different size cartons in the slug of cartons 54.

The slug gate assembly 640 is only employed with small carton slugs that have a tendency to burst open while being moved laterally by side pusher 30. The slug gate assembly 640 is also shown in FIGS. 22, 24 and 25 and incorporates a pair of transverse rods 661. The rods 661 are adjustably clamped through flange mounts 663. The flange mounts 663 are attached to the lower outboard surface of the left frame member 498 to cooperate with slots 665 therethrough. A spanner bar 667 is fixedly attached across the inboard extremities of the transverse rods 661 to provide mounting for a flexible member 669 that hangs downwardly therefrom. A plurality of bolts (not shown) pass through clear holes in a clamp bar 671, through matching clear holes in the flexible member 669 and threadably mount into the spanner bar 667. A drag plate 673 is fixedly attached along the lower inboard surface of the flexible member 669. As a slug of small cartons moves laterally to the left by means of the side pusher 30, the upper left edge of the slug moves against the drag plate 673 deflecting the flexible member 669 outboardly. The drag plate 673 moves around the upper left corner of the slug of cartons and slides over the top thereof to help in retaining the slug in longitudinal alignment.

A limit switch LS-9 is fixedly attached upon the top surface of a switch mount 674 that is in turn fixedly attached upon the top left hand surface of the carriage plate 517 of the slide assembly 447. A switch arm and roller 676 extends upwardly and in the input direction from the limit switch LS-9 to work against the top input surface of the left hand member of the pair of holdback arms 586 (FIG. 23) of the upper backstop 449 to indicate that the upper backstop 449 is in its up position.

A T-shaped member 678 (FIG. 24) is fixedly attached to the top surface of the limit switch LS-9 and extends outboardly therefrom to function as a switch trip for limit switches LS-1 and LS-1A. The limit switches LS-1 and LS-1A are fixedly attached upon the top surface of slide mounts 680-1 and 680-1A. The slide mounts 680-1 and 680-1A are so constructed so as to slideably cooperate with the top and side surfaces of a longitudinal bar 682. The downwardly extending sides of the slide mounts 680-1 and 680-1A clampedly cooperate with a clamp plate 684 to fixedly attach the limit switches LS-1 and LS-1A in adjusted place. Bolts 686 pass upwardly through clear holes in the input end of the clamp plate 684 to threadably mount into the downwardly extending sides of the slide mount 680-1A. Bolts 688 pass upwardly through slots in the output end of the clamp plate 680 to threadably mount into the downwardly extending sides of the slide mount 680-1. In this manner, both limit switches LS-1 and LS-1A can be adjusted with respect to the slug length and with respect to each other. The longitudinal bar 682 is mounted on brackets 689 attached to the left frame member 498.

A switch arm and roller 690 of the limit switch LS-1A cooperates with the T-shaped member 678 to indicate that a slug of cartons 54 does not have enough cartons in it to pack the slug and start a new cycle. LS-1A is a minimum size slug safety switch. A switch arm and roller 692 of the limit switch LS-1 also cooperates with the T-shaped member 678 to indicate that a slug of cartons 54 is over count and can make a circuit that packs the slug and subsequently starts a new cycle. LS-1 is a safety switch that determines the maximum size slug.

A limit switch LS-6 is fixedly attached to the right hand surface of the right frame member 502 of the cantilever frame 497 adjacent the right hand standoff 506 of the slide assembly 447. A switch arm and roller 694 of the limit switch LS-6 cooperates with the right hand input edge of the carriage plate 517 to indicate to the control circuitry that the slide assembly 447 is against the stops 571.

A limit switch LS-11 is fixedly attached to the input outboard surface of an adjustable mount plate 696 that is in turn fixedly but adjustably attached to the outboard surface of the right frame member 502. Bolts 697 pass through a pair of slots 698 (FIG. 22) in the output end of the adjustable mount plate 696 and threadably mount into the right frame member 502 at a longitudinal position approximating its center. A switch arm and roller 699 (FIG. 24) of the limit switch LS-11 cooperates with the right hand output edge of the carriage plate 517 when it is moving in the output direction. The limit switch LS-11 is a safety switch that halts the machine if the side pusher 30 has not returned to the right side of the slug accumulator 10. It is to be noted that the carriage plate 517 passes the switch trip and roller 799 completely as it progresses in the output direction.

Table Assembly

Figure 23:
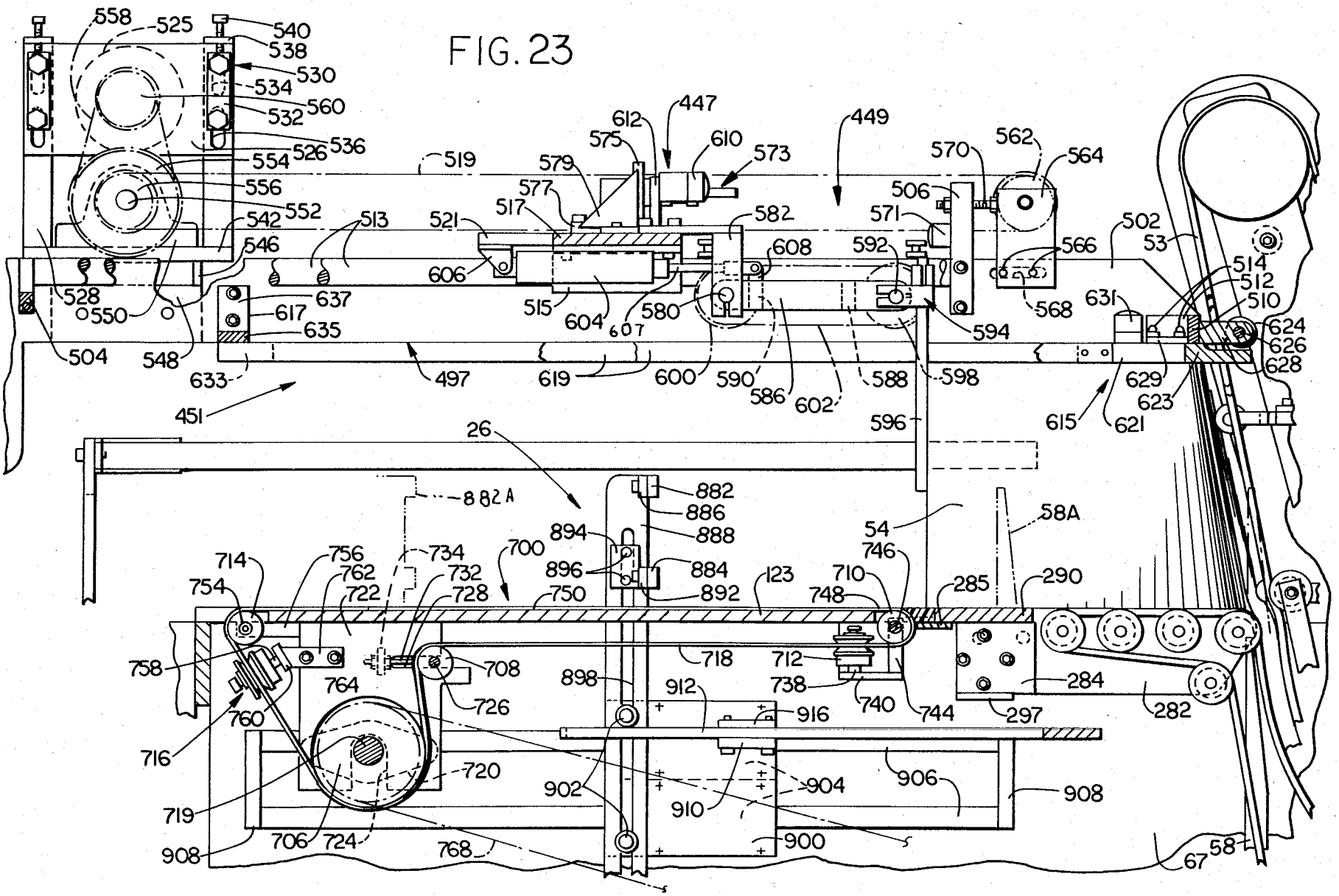
FIG. 23 is a fragmentary view partly in side elevation and partly in section.

The table assembly 24 is shown in FIGS. 13, 22 and 23 and is comprised of the main plate 123, a table belt assembly 700, a right hand guide 702, and a left hand guide assembly 704.

The main plate 123 incorporates features that cooperate with the lower stop assembly 26 and the table belt assembly 700 and will be discussed in detail in relation to these assemblies.

The table belt assembly 700 is comprised of a drive roller 706, a tension roller 708, an input roller 710, input side guide pulleys 712, an output roller 714, output side guide pulleys 716, and a belt 718. The drive roller 706 is fixedly attached to a drive shaft 719 that is in turn rotatably mounted in two bearings 720. The bearings 720 are fixedly attached to the outboard surfaces of a pair of hanger mounts 722. The hanger mounts 722 are fixedly attached in spaced and parallel relationship to the bottom surface of the main plate 123. The hanger mounts 722 incorporate round end slots 724, entering vertically from the bottom edge thereof, to provide assembly access for the drive shaft 719.

The tension roller 708 is rotatably mounted upon a tension shaft 726 that resides in round end slots 728 that enter horizontally into the hanger mounts 722 from the input edge thereof. The tension shaft 726 is laterally retained in the round end slots 728 by a pair of spacers 730 that cooperate with the ouboard surfaces of the pair of hanger mounts 722. The tension shaft 726 is longitudinally retained and adjusted in the round end slots 728 by a pair of eye bolts 732, whose threaded shanks pass through clear holes in retainer lugs 734. The retainer lugs 734 are rigidly affixed to the outboard surfaces of the hanger mounts 722 just behind the round end slots 728. A pair of nuts 736 is employed to adjust and fixedly retain each of the eye bolts 732 in the retainer lugs 734.

The belt 718 passes counterclockwise about the lower circumference of the drive roller 706 and rises vertically upward to pass clockwise over the tension roller 708. The belt 718 then passes horizontally in the input direction to pass between the input side guide pulleys 716 and counterclockwise around the input roller 710.

The input side guide pulleys 712 are rotatably mounted upon shafts 738 whose lower ends are threadably mounted into the upper surface of and at the inboard output corner of a pair of input mounts 740. The input mounts 740 are rigidly affixed along outboard upper edges to the bottoms of hanger blocks 742. Bolts 743 pass downwardly through clear and counterbored holes in the main plate 123 to threadably mount into the hanger blocks 742, fixedly attaching them in spaced and parallel relationship thereto. A riser mount 744 is rigidly affixed in upright orientation upon the upper surface of, and at the input inboard corner of each of the input mounts 740. An input shaft 746 is fixedly attached between upper end portions of the riser mounts 744. The input roller 710 is rotatably mounted upon the input shaft 746 and resides in a rectangular cutout 748 in the input end of the main plate 123. The vertical elevation of the input roller 710 is such that the top surface of the belt 718 comes flush with the top surface of the main plate 123. Under these circumstances, a gap exists between the output edge of the table input plate 290, the leading edge of the input roller 710 and accompanying belt, and laterally between the edges of the rectangular cutout 748 in the input edge of the main plate 123. Surface continuity is maintained by the addition of a filler block 749 that conforms to the shape and size of the void, and is fixedly attached in place upon the top surface of the connector bar 285. A longitudinal channel 750 is provided in the upper surface of the main plate 123, the depth and width thereof is sufficient to accept the belt 123. The top extremities of the pair of riser mounts 744 reside in a shallow depression 752 milled in the underside of the main plate 123 adjacent the rectangular cutout 748.

The belt 718 passes through the longitudinal channel 750 of the main plate 123 to pass counterclockwise around the output roller 714 and downwardly between the output side guide pulleys 716 before returning to the drive roller 706. The output roller 714 is rotatably mounted upon an output shaft 754 that is in turn fixedly attached between a pair of cantilever bars 756. The cantilever bars 756 are rigidly affixed at their input ends to the upper output edges of the pair of hanger mounts 722 in such a manner that the inboard surfaces thereof are flush with one another. The output side guide pulleys 716 are rotatably mounted upon short shafts 758 whose mounted ends are threadably retained in a cross bar 760. The output surface of the cross bar 760 faces somewhat downwardly to bring the output side guide pulleys 716 into alignment with the local segment of the belt 718. A pair of longitudinal members 762 is rigidly affixed to the input surface of, and at the output ends of the cross bar 760, and extend in the input direction therefrom to be fixedly attached to the upper outboard surfaces of the pair of hanger mounts 722.

A drive sprocket 764 is fixedly attached to the left end of the drive shaft 719 and receives power from the fourth drive shaft 261 of the paired incline belts 18 as is shown in FIGS. 8, 11 and 23. A takeoff sprocket 766 is fixedly attached to the left side of the fourth drive shaft 261 and communicates with the drive sprocket 764 by means of a table chain 768. (The composite assembly is shown schematically in FIG. 1.) The table chain 768 is tensioned by two tension pulleys 770 rotatably mounted upon short cantilever shafts that are in turn fixedly attached to the inboard surface of, and at the ends of a rocker arm 772. A rocker pin 774 is rigidly affixed into the outboard surface of, and at the center of the rocker arm 772, and cooperates with a clamp collar 776 that is appropriately affixed to a foot mount 778. The foot mount 778 is fixedly attached to the inboard surface of the left hand side plate 69 and appropriately placed at assembly to properly tension the table chain 768. With respect to FIG. 8, the rocker arm 772 is rotated clockwise until proper tension is achieved, and the assembly locked in place by means of the clamp collar 776.

The left hand guide assembly 704 is shown in FIGS. 13, 22, 26, 27 and 28, and incorporates a left side guide 781. The input end of the left side guide 781 is mildly angled outboardly to facilitate the entry of the slug of cartons 54, and the output end is acutely turned outboardly to facilitate the entry and guidance of the laterally moving slug of cartons 54. A pair of lugs 783 (FIGS. 13 and 26) is rigidly and spacedly affixed upon the input facing surface of the output end of the left side guide 781 to accommodate the pinned attachment of a roller chain 785. The roller chain 785 incorporates straight lug link plates 787 that provide mounting for Teflon blocks 789 fixedly attached therebetween. The Teflon blocks 789 are sized to touch each other when the roller chain 785 is extended straightly. The result is that the chain can turn in only one direction; away from the side incorporating the Teflon blocks 789. Attempting to turn the chain toward the side incorporating the Teflon blocks 789 yields a stiff structure. The roller chain 785 extends laterally to the left from the pair of lugs 783 and is turned around and into the input direction along the left side of the slug accumulator 10 by a corner guide 791. The corner guide 791 is rigidly affixed upon the top extremity of a riser bar 793 that is in turn fixedly attached to the inboard surface of the left hand side plate 69. The roller chain 785 extends in the input direction and is pivotally attached to a lug 795 (FIGS. 13 and 27) that is in turn rigidly affixed to the upper outboard corner of the output surface of a clamp 797. The clamp 797 incorporates a slot 799 in the bottom surface thereof that cooperates with the top edge of the left hand side plate 69. A screw 800 threadably passes laterally to the right through the lower left portion of the clamp 797 to bear against the outboard surface of the left hand side plate 69 to fixedly but adjustably hold the input extremity of the roller chain 785 in place.

Figure 28:
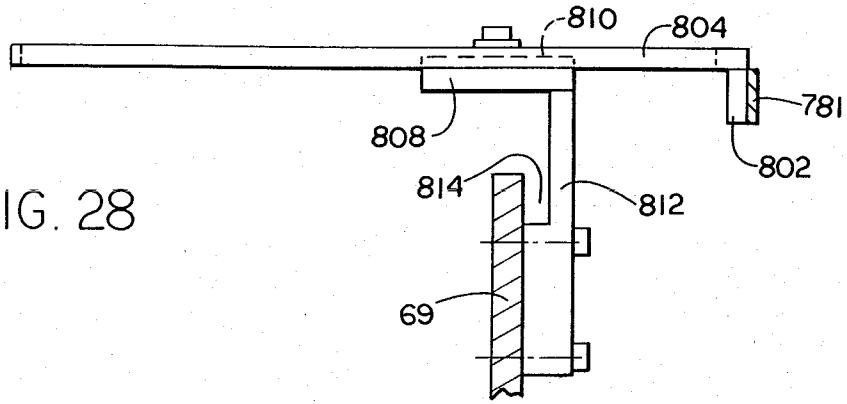
FIG. 28 is a view in section taken on an enlarged scale on the line 28—28 in FIG. 13.
Figure 26:
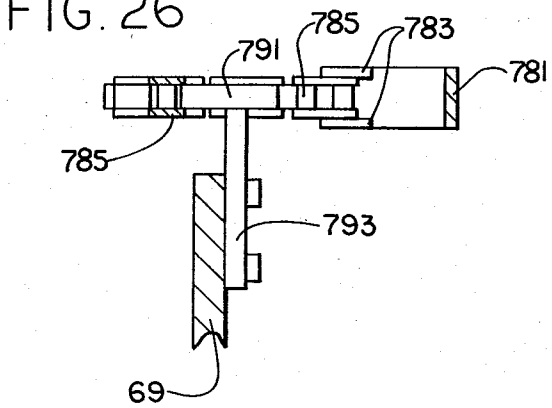
FIG. 26 is a view in section taken on an enlarged scale on the line 26—26 in FIG. 13.
Figure 27:
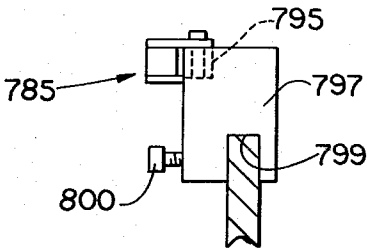
FIG. 27 is a view in section taken on an enlarged scale on the line 27—27 in FIG. 13.

Referring now to FIGS. 13, 22 and 28, the input portion of the left side guide 781 is rigidly affixed to the inboard side of a mount block 802 that is in turn rigidly affixed at its top surface to the bottom input edge of a lateral adjustment bar 804. The lateral adjustment bar 804 incorporates a long slot 806 and is fixedly and adjustably attached across the top surface of a mount member 808. The top surface of the mount member 808 incorporates a ridge 810 that cooperates with the long slot 806 to provide continued lateral placement of the lateral adjustment bar 804 during adjustment. The mount member 808 is rigidly affixed in cantilever form to the top extremity of a standoff mount 812 that is in turn fixedly attached to the inboard surface of the left hand side plate 69. The standoff mount 812 provides a clear space 814 between itself and the left hand side plate 69 to provide for passage of the clamp 797 (FIG. 27). This circumstance occurs for roller chains 785 long enough to accommodate the narrowest slug of cartons 54.

The left side guide 781 can therefore be adjusted laterally to guide slugs of cartons of different widths. As the left side guide 781 is moved inboardly, the transverse segment of the roller chain 785 becomes longer, but is able to perform as a rigid guide for the lateral moving slug of cartons 54 due to the Teflon blocks 789.

The right hand guide 702 incorporates a flat guide member 816 whose input end is slightly turned outward to facilitate the entry of the incoming slug of cartons 54. It is mounted in the same way, but in mirror image, to the left side guide 781 as was previously described.

The extraction assembly 28 is comprised of a horizontal slide assembly 807, a vertical slide assembly 809, a lift assembly 811, and the set of fingers 58 as shown in FIGS. 8 and 11. The horizontal slide assembly 807 incorporates a base plate 813 that is fixedly attached atop the first and second lateral members 75 and 77, respectively, through the intervening cooperation of thread blocks 815. The base plate 813 is centrally located upon the lateral members 75 and 77, and provides mounting for slide rods 817. The slide rods 817 are fixedly attached between a set of rod mounts 819 that is in turn fixedly attached to the base plate 813, favoring the output end thereof. The slide rods 817 cooperate with a set of four linear bearings 821. The bearings 821 are spacedly affixed in rectangular pattern to the underside of an extraction plate 823. The extraction plate 823 is motivated in the longitudinal direction by an extraction cylinder 825 that is in turn fixedly attached to, and located upon the centerline of the base plate 813 through the intervening cooperation of spacers 827. The working end of an extraction cylinder rod 829 is threadably and fixedly attached into a thread block 831 that is in turn fixedly attached to the lower input surface of a mount hanger 833. The upper extremity of the mount hanger 833 is fixedly attached to the bottom surface of, and at the central output edge of the extraction plate 823. A rectangular hole 835 is provided in the extraction plate 823 to gain access to the attachment of the extraction cylinder rod 829 to the thread block 831. When the extraction plate 823 is in the position shown in FIG. 11, a right hand input corner of the plate 823 engages an actuator roll 837 of a limit switch LS-17. The limit switch LS-17 is mounted on adjustment plate 839. The plate 839 includes slots 847 through which bolts 849 extend to mount the plate 839 on a bar 851, which in turn is carried on the right hand side plate 67.

The vertical slide assembly 809 is mounted upon the top input surface of the extraction plate 823. A vertical bar 824 is fixedly mounted to the top surface of the extraction plate 823 adjacent the input edge of the rectangular hole 835. The vertical bar 824 is fixedly supported in upright disposition by a bottom gusset 826. A top plate 828, somewhat triangular in shape, is fixedly attached at its output edge to the upper extremity of the vertical bar 824. The top plate 828 is fixedly supported in horizontal plane by an upper gusset 830. Two vertically disposed bearing rods 832 are fixedly and spacedly attached between the input edges of the top plate 828 and the extraction plate 823. The bearing rods 832 cooperate with two linear bearings 834 that are in turn fixedly attached to the output surface of a standoff plate 841. A pair of standoff tubes 843 is rigidly affixed in spaced and parallel relationship to the input surface of the standoff plate 841. The input ends of the standoff tubes 843 are closed by end caps 845. A finger plate 836 is fixedly attached at its output surface to the input surfaces of the end caps 845. Narrowly spaced and fixedly attached upon the input surface of the finger plate 836 is the set of fingers 58. It is to be noted that the upper extremities of the fingers are tapered, producing a ramp 838 upon the input surface thereof. In operation, as the set of fingers 58 rises, the ramps 838 contact the pusher wheels 351 of the pusher wheel assembly 349 on the output side thereof and forces them to move in the input direction against the compression springs 341 that provide relief for the set of pressure wheels 322.

The finger plate 836 is motivated in vertical displacement by the lift assembly 811 that incorporates a finger cylinder 840. The finger cylinder 840 is pivotally mounted to a lug 842 that is in turn rigidly affixed to the upper output surface of the riser plate 844. The riser plate 844 is rigidly affixed to the upper output edge of a plate 846 and is rigidized thereupon by two gusset plates 848. Referring to FIG. 11, it is to be noted that the riser plate 844 is of narrow width, the gusset plates 848 are rigidly affixed to the left and right edges thereof, and the plate 846 extends yet outboardly from the gussets to form flanges for fixedly mounting the assembly upon the upper surface of the top plate 828. The heads of the screws that mount the top plate 828 to the vertical bar 824 and the upper gusset 830 reside in clearance holes in the middle portion of the plate 846.

The working end of a cylinder rod 850 of the finger cylinder 840 is threadably and fixedly attached into the top surface of a pivot block 852. The pivot block 852 incorporates a lateral pin 854 that is in turn pivotally mounted through the upper output ends of a pair of arms 853. The arms 853 are held in parallel spaced relationship by a spacer cylinder 855 fixedly attached at the centers thereof. The arms 853 are pivotally attached to a pivot block 857 that is in turn rigidly affixed upon the central output face of the vertical bar 824. It is to be noted that the width of the pivot block 857 is the same as the width of the vertical bar 824 for free passage of the pair of arms 853. The lower extremities of the arms 853 are attached to the standoff plate 841 by a pair of links 858. The upper ends of the links 858 are pivotally mounted upon an arm pin 860 that is transversely and fixedly attached through the lower ends of the arms 853. Set screws are provided in the lower ends of the arms 853 for retention of the pin 860. The lower ends of the links 858 are pivotally mounted upon a lug pin 862. The lug pin 862 is fixedly attached transversely through the lower portion of a lug mount 864 that is in turn fixedly attached to the output surface of, and at the bottom center of the standoff plate 841. The pair of links 858 permits the standoff plate 841 to move vertically upon the bearing rods 832 while the input ends of the arms 853 move up and down along an arcuate path.

An up stop 866 for the vertical slide assembly 809 is fixedly attached upon the top output surface of a plate 868 that is in turn fixedly attached across the upper output surface of the extraction plate 823 through the intervening auspices of a pair of spacers 870. The inboard screws of the two output bearings of the set of four bearings 821 of the extraction plate 823 are used to fixedly attach the plate 868 to the extraction plate 823. The screws, four in all, pass upwardly through matching clear holes in the inboard flanges of the bearings, the extraction plate 823, and the spacers 870 to threadably mount into the plate 868. The up stop 866 is located on the centerline of the extraction assembly 28, and cooperates with an adjustable stop 872 that is comprised of a disk and threaded shank. The disk functions as a handle and the threaded shank cooperates with a threaded bore in a threaded clamp collar 876. A block 874 is rigidly affixed to the bottom surface of the pivot block 852. The threaded clamp collar 876 is appropriately attached to the bottom surface of the block 874 to clampedly retain the adjustable stop 872 in fixed place.

A limit switch LS-2 is fixedly attached to the upper input surface of a switch bar 878 that is in turn fixedly attached across the upper right hand side of the plate 868. The switch bar 878 extends off the input edge of the plate 868 in cantilever form to bring a switch arm and roller 880 of the limit switch LS-2 into working relationship with the right hand bottom surface of the adjustable stop 872. The limit switch LS-2 indicates to the control circuitry that the vertical slide assembly 809 is up and the extraction cylinder 825 can be extended.

A limit switch LS-15 is fixedly mounted in transverse orientation across the upper output surface of an extension plate 879 that is in turn fixedly attached in cantilever form from the bottom output surface of the base plate 813. A switch arm and roller 881 of the limit switch LS-15 works against the output surface of the mount hanger 833 of the extraction cylinder 825 to indicate to the control circuitry that the horizontal slide assembly is in the output position and that the side pusher 30 can be actuated.

The lower stop assembly 26 incorporates an upper stop bar 882 and a lower stop bar 884 as is shown in FIGS. 8, 11 and 23. The discharge position of the upper stop bar 882 is shown in dot-dash lines at 882A in FIG. 23. The upper stop bar 882 is fixedly attached in transverse orientation across the table assembly 24 to a bar mount 886 that is in turn rigidly affixed in a notch in the upper input corner of an upright bar 888. The upright bar 888 extends vertically downward through a slot 890 in the main plate 123 of the table assembly 29 as is shown in FIG. 13. The lower stop bar 884 is likewise fixedly attached to a lower bar mount 892 that is in turn rigidly affixed at its right hand output end to the lower input edge of a clamp plate 894. Bolts 896 pass transversely to the right through clear holes in the clamp plate 894, a vertical slot 898 in the upright bar 888, and threadably mount into a nut plate (not shown) in the right side of the upright bar 888. In this manner, the lower stop bar 884 is made vertically adjustable upon the upright bar 888.

The lower portion of the upright bar 888 is fixedly and adjustably attached to the left hand surface of, and along the output edge of, a bearing plate 900 by screws and washers 902 that pass through the vertical slot 898 to threadably mount into the bearing plate 900. Two linear bearings 904 are fixedly attached upon the outboard side of, and toward the input edge of the bearing plate 900 to cooperate with a pair of longitudinal rods 906. The longitudinal rods 906 are fixedly attached between a pair of rod mounts 908. The rod mounts 908 are fixedly attached to the upper inboard surface of the right hand side plate 67.

An attachment lug 910 is rigidly affixed along its right hand edge, to the upper left hand side of, and at the input edge of the bearing plate 900. A connector bar 912 incorporating a long slot 914 passes over the top surface of the attachment lug 910 and is fixedly and adjustably attached thereto by a pair of bolts and a nut plate 916. As before, the bolts pass upwardly through clear holes in the mount lug 910, through the slot 914 and threadably mount in the nut plate 916. The connector bar 912 extends in the input direction and is fixedly attached to the upper surface of the top plate 828 of the extraction assembly 28 by means of a lateral extension 918. The lateral extension is an integral part of the connector bar 912. In this manner, the lower stop assembly 26 can be adjusted relative to the set of fingers 58 of the extraction assembly 28 to properly hold slugs of cartons 54 of different lengths.

The side pusher 30 is comprised of a pusher bar 907, a lateral slide 909, and a pusher cylinder assembly 911 as is shown in FIGS. 9, 12 and 13. The pusher bar 907 is a longer member longitudinally disposed above the table assembly 24. A flange plate 913, laterally disposed, is rigidly affixed across the output extremity of the pusher bar 907. The flange plate 913 is rigidized upon the pusher bar 907 by means of a pair of gussets 915. The pusher bar 907 is fixedly attached to the upper input surface of an adjustment plate 917 by three bolts 919 that pass through clear holes in the adjustment plate 917 and threadably mount into the flange plate 913.

The adjustment plate 917 incorporates two long slots 921 that are vertically disposed along the sides thereof and a threaded block 923 that is fixedly attached to the bottom output surface of and at the center thereof. The adjustment plate 917 is fixedly and adjustably attached to the output surface of a pusher slide plate 925 by bolts 927 that pass through clear holes in clamp plates 929, through the two long slots 921 and threadably mount into the upper portion of the pusher slide plate 925. The adjustment plate 917 is adjusted and held in vertical place by a jack screw 929' that threadably cooperates with the threaded block 923 and extends downwardly therefrom. The jack screw 929' integrally incorporates a thrust collar 931 near the lower end thereof and a bearing spindle 933 at the bottom extremity thereof. The thrust collar 931 bears downwardly upon the top surface of a jack mount 935 through the intervening auspices of a thrust washer. The bearing spindle 933 is rotatably mounted in and extends through the jack mount 935 that is in turn fixedly attached to the lower output surface of the pusher slide plate 925. The jack screw 929' is retained in the jack mount 935 by a shaft collar 937 fixedly attached at the bottom end of the bearing spindle 933. The jack screw 929' is rotated with the aid of an Allen wrench that is inserted into a machine screw 939 that is threadably and rigidly affixed into the upper extremity thereof.

The pusher slide plate 925 incorporates two linear bearings 926 fixedly attached across the upper and lower edges of the input surface thereof. The two linear bearings 926 cooperate with laterally disposed pusher rods 928 that are in turn fixedly attached between pusher mount plates 930. The upper input edges of the pusher mount plates 930 are fixedly attached to the output surface of and at the ends of the upper output plate 117. The pusher mount plates 930 are rigidized in spaced and parallel alignment by a stabilizer bar 932 that is fixedly attached between lower output extensions 940 of the pusher mount plates 930. Smaller upper output extensions 942 of the pusher mount plates 930 provide for fixed attachment of the longitudinal plates 475 of the outboard braces 471 of the vertical slide assembly 453 (FIG. 21).

The pusher slide plate 925 is motivated transversely by a pusher cylinder 946. The pusher cylinder 946 is pivotally mounted to a right cylinder lug 947 that is in turn rigidly affixed to the lower inboard surface of, and at the output end of the right hand member of the lower output extension 940 of the pusher mount plates 930. Extending downwardly and inboardly, the working end of a cylinder rod 948 of the pusher cylinder 946 is threadably and fixedly mounted into a rod clevis 950.

The inwardly facing surfaces of the tines of the rod clevis 950 cooperate with the outer surfaces of a pusher clevis 952. The cylinder rod clevis 950 is pivotally attached to the upper end of the pusher clevis 952 by a pins 954. An adjusting arm 956 resides in the space between the tines of the pusher clevis 952, and extends downwardly in line therewith to be fixedly attached to a pusher pivot shaft 953. The upper portion of the adjusting arm 956 incorporates a central slot 955. The pusher clevis 952 is coupled to the adjusting arm 956 by two bolts 957 that pass through clear holes in the output tine of the pusher clevis 952, through the central slot 955 of the adjusting arm 956, and threadably mount in the input tine of the pusher clevis 952. The pusher clevis 952 and the adjusting arm 956 are held in working alignment with each other by a pair of arm guide plates 959 that are fixedly attached to the right and left sides of the adjusting arm 956. Being wider than the adjusting arm 956, the arm guide plates 959 overlay the tines of the pusher clevis 952. As is shown in the figures, the pusher clevis 952 and the adjusting arm 956 are fully collapsed, the distance between the center of the pusher pivot shaft 953 and the center of the pin 954 being a minimum. As this distance is increased, the arc through which the pin 954 can move increases, thus demanding a longer stroke on the pusher cylinder 946. Since the pusher cylinder is a fixed stroke element, the angle through which the adjusting arm 956 pivots decreases as the assembly is lengthened.

The pusher pivot shaft 953 is pivotally mounted in a pair of bearings 961A and 961B that are fixedly and spacedly attached to bearing mounts 963A and 963B, respectively. The output bearing mount 963A is rigidly affixed across the upper output surface of the central cantilever bar 85, while the input bearing mount 963B is rigidly affixed across the central output surface of the output lateral bar 79. A pusher arm 965 is fixedly attached upon the pusher pivot shaft 953 between the bearings 961A and 961B and in alignment with the adjusting arm 956. The upper end of the pusher arm 965 incorporates a slot 967 in which a camroll 966 operates. The camroll 966 is rotatably mounted in a camroll mount assembly 968. The camroll mount assembly 968 is comprised of a camroll base 970, two camroll spacers 972, and a camroll stiffener 974. Two rather long screws 976 pass in the output direction through clear holes in the ends of the camroll stiffener 974, through cooperating holes in the camroll base 970, to threadably mount into the input surface of, and at the center of, the pusher slide plate 925. The camroll mount 968 provides a clear space in which the camroll 966 and the pusher arm 965 can reside. A shaft bolt 978 passes in the output direction through the center of the camroll stiffener 974, through the camroll 966, and threadably and fixedly mounts into the camroll base 970. In this manner, the slot 967 permits the pusher arm 965 to swing laterally along an arcuate path while moving the pusher slide plate 925 along a straight path. The length of travel is determined by the adjusting arm 956 and the pusher clevis 952. If this adjustment is completely collapsed as has been discussed, a right hand resilient stop 980R and a left hand resilient stop 980L will work against the right and left sides, respectively, of the pusher slide plate 925 to define its maximum travel. The stops 980R and 980L are mounted on the pusher mount plates 930.

A limit switch LS-4 is fixedly attached in transverse orientation to the horizontal flange of an angle mount 982 that is in turn fixedly attached to the right hand surface of the right hand member of the pair of cantilever plates 469 of the vertical slide assembly 453. The limit switch LS-4 is longitudinally located adjacent the output end of the right side plate 67 so that a switch arm and roller 984 can cooperate with the right hand extremity of a switch trip 986. The right hand extremity of the switch trip 986 incorporates a right angle flange to present a sufficiently large working area to the switch arm and roller 984. The switch trip 986 also incorporates a long slot 988 through which bolts pass to fixedly and adjustably attach the switch trip 986 across the lower output surface of the pusher slide plate 925. The limit switch LS-4 indicates that the side pusher 30 is in its home position and indicates to the control circuitry that the side pusher 30 will not hinder further formation and packing of a slug of cartons 54.

A limit switch LS-10 is fixedly attached to the lower right hand surface of a switch hanger 985 that is in turn fixedly attached to the left hand output end of the left hand member of the longitudinal plates 475. The working end of the limit switch LS-10 extends in the input direction to bring a switch arm and roller 987 in working relationship with the left hand edge of the pusher slide plate 925 as is indicated in dot-dash line in FIG. 13. The limit switch LS-10 indicates to the control circuitry that the pusher is fully actuated, completing the pack cycle.

Counter

Figure 29:
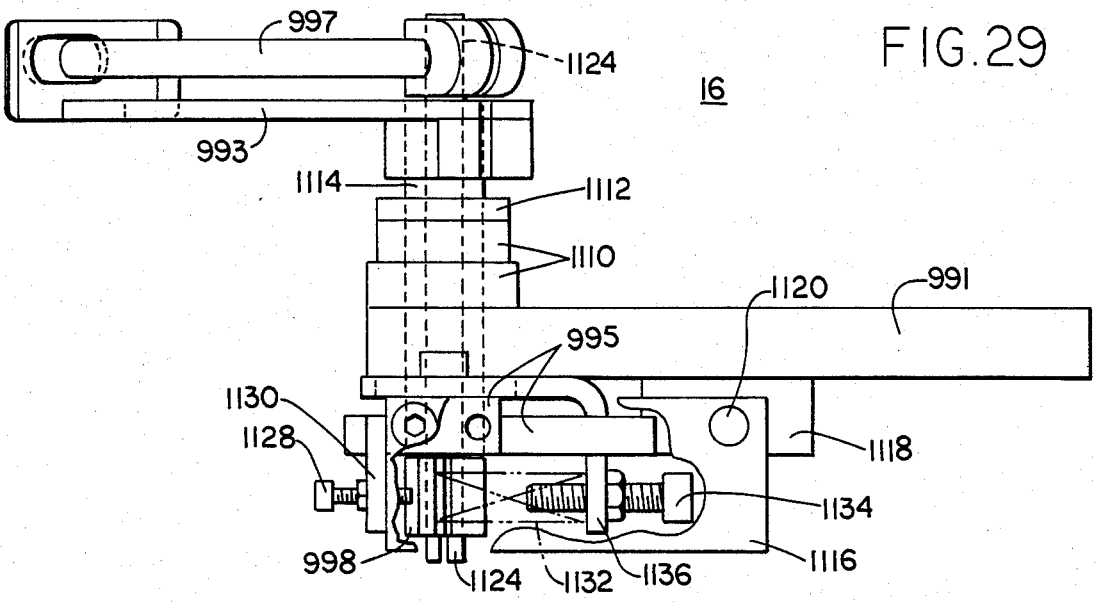
FIG. 29 is a top plan view of a counter assembly of the machine.
Figure 30:
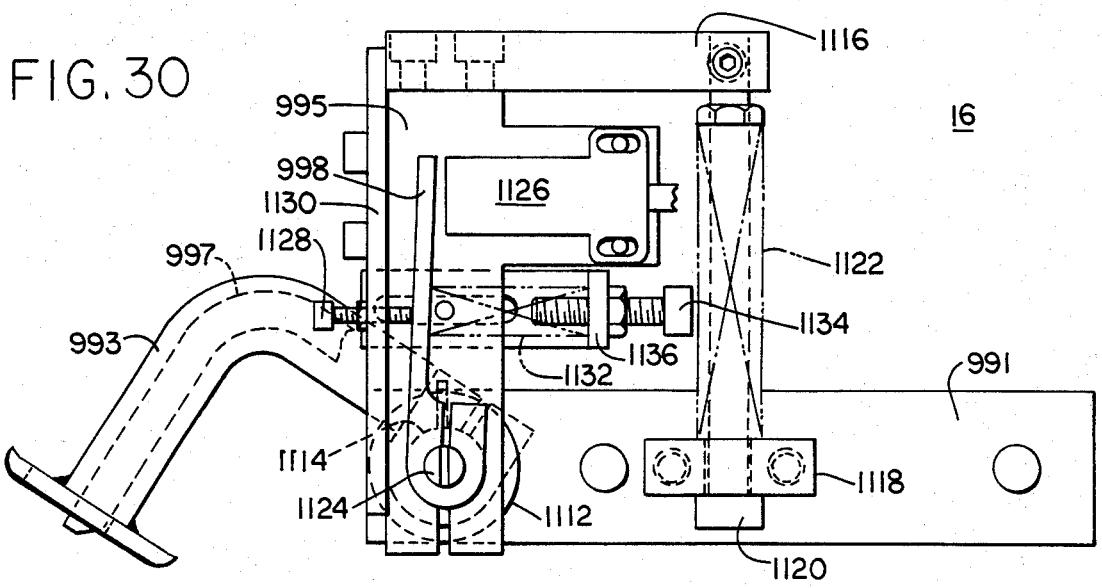
FIG. 30 is a view in side elevation of the counter assembly shown in FIG. 29.

The counter assembly 16 is shown in FIGS. 29 and 30. The counter assembly can respond rapidly to the tight shingle of cartons 38. The counter assembly 16 is comprised of a base 991, a shoe assembly 993, a switch mount 995, a counter finger 997 and an interruptor 998. The base 991 is mounted on the partial belt plate 238. A cylindrical extension 1110 is rigidly affixed to the right hand surface of, and at the output end of the base 991. A clear bore passes laterally through the cylindrical extension 1110 and the base 991 and compressively receives a flange bearing 1112 (only the flange of which shows in the drawings). A coaxial shaft 1114 is pivotally mounted in the flange bearing 1112 and extends outwardly to the left and right thereof. The shoe assembly 993 is fixedly clamped about the right end of the coaxial shaft 1114 while the switch mount 995 is fixedly clamped about the left end of the coaxial shaft 1114. This provides a fixed relationship between the shoe assembly 993 and the switch mount 995. A spring arm 1116 is fixedly attached in cantilever form to the top extremity of the switch mount 995 and extends in the input direction therefrom. A stop block 1118 is fixedly attached to the left side of, and at the center of the base 991. The stop block 1118 incorporates a clear bore, vertically disposed, through which a spring bolt 1120 passes. The bolt 1120 passes upwardly through the clear bore in the stop block 1118 to be threadably and fixedly mounted in the input end of the spring arm 1116. A nut is provided near the upper end of the spring bolt to serve as an adjustable stop for a compression spring 1122. The compression spring 1122 urges the spring arm 1116, the switch mount 995, the coaxial shaft 1114 and the shoe assembly 993 to rotate counterclockwise with respect to FIG. 30. This spring loading will seat the shoe assembly atop the shingle of cartons 38 regardless of shingle thickness. The head of the spring bolt 1120 functions as a stop when the shingle of cartons is not present.

A counter shaft 1124 is pivotally mounted by means of appropriate bushings through the coaxial shaft 1114 and extends to the left and right therefrom. The counter finger 997 is fixedly clamped to the right hand end of the counter shaft 1124. The interruptor 998 is fixedly clamped to the left end of the counter shaft 1124 and rises upward so that its upper portion resides adjacent the working end of a proximity counter 1126. The proximity counter 1126 is fixedly but adjustably attached to the left side of the switch mount 995. Counterclockwise rotation of the interruptor 998 is limited by a stop screw 1128 that is threadably and adjustably mounted through a flange plate 1130 that is in turn fixedly attached to the output edge of the switch mount 995. The interruptor 998 and the counter finger 997 are constantly urged in the counterclockwise direction by a second compression spring 1132. The second compression spring 1132 loosely resides upon a screw 1134 that is in turn threadably and fixedly attached through the lateral leg of an L-shaped adjustment bracket 1136. The longitudinal leg of the adjustment bracket 1136 incorporates a slot so that the adjustment bracket 1136 is adjustably attached to the right hand surface of the switch mount 995. The proper spring pressure can therefore be brought against the input surface of the interruptor so that proper pulsation thereof is achieved. The unit is adjusted in such manner so that the working end of the counter finger extends only slightly through the shoe of the shoe assembly 993 for proper sensing of each carton. In this manner, proper utilization is made of the fast response time inherent in the proximity switch 1126.

Figure 19:
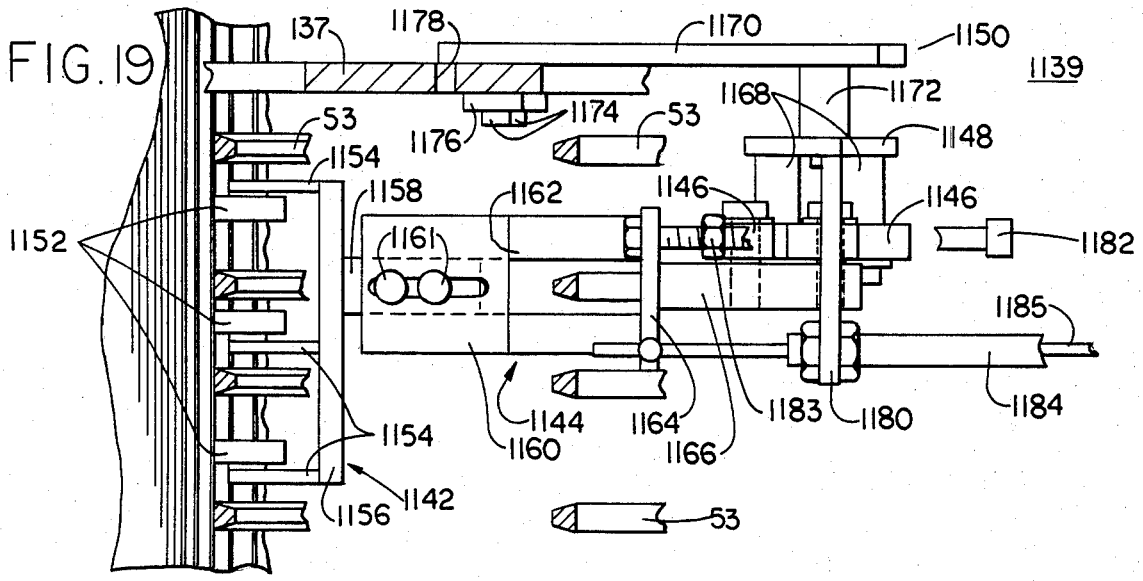
FIG. 19 is a view in section taken on the lines 19—19 in FIG. 6.
Figure 31:
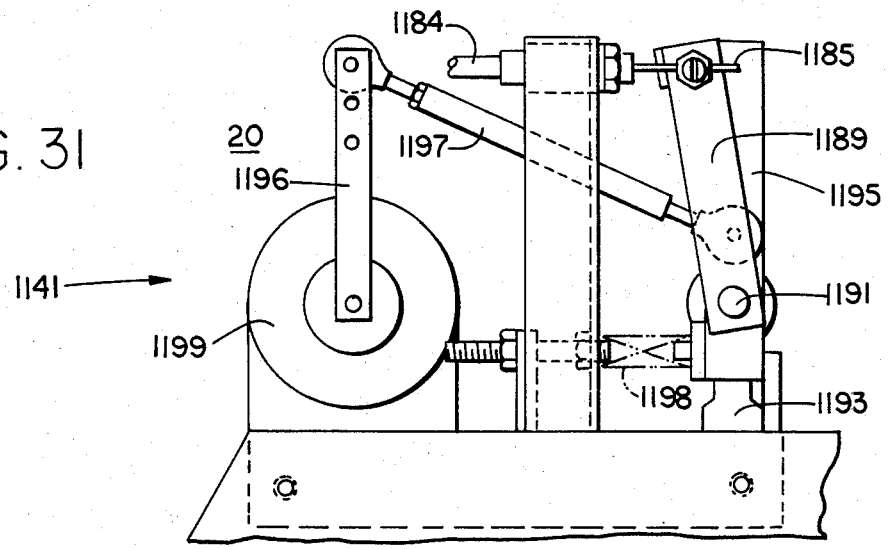
FIG. 31 is a view in side elevation of a microtorque assembly of the machine.

The microtorque control assembly 20 is shown in FIGS. 6, 19 and 31, and is comprised of a follower assembly 1139 and a control assembly 1141. The follower assembly 1139 (FIGS. 6 and 19) is comprised of a wheel mount 1142, a ram assembly 1144, a pair of parallel arms 1146, a base or mount plate 1148 and a standoff mount 1150. The output extremity of the wheel mount 1142 rotatably incorporates three follower wheels 1152. The follower wheels 1152 are mounted upon the output ends of extension arms 1154 that are in turn rigidly affixed at the input extremities to the output surface of a cross bar 1156. They are laterally placed thereupon to cooperate in placing the three follower wheels 1152 between the set of top belts 53 of the pair of incline belts 18. The output extremity of an attachment bar 1158 is rigidly affixed to the input surface of, and favoring the right side of the cross bar 1156.

The follower assembly 1139 is fixedly and adjustably attached to the bottom surface of a slotted plate 1160 of the ram assembly 1144. Bolts 1161 pass downwardly through the slotted plate 1160 and threadably mount into the attachment bar 1158 providing the three follower wheels 1152 with a small degree of longitudinal adjustment. The attachment bar 1158 fits closely between a pair of extension bars 1162 to provide lateral stability thereto. The upper output surface of the extension bars 1162 is rigidly affixed to the bottom surface of the slotted plate 1160, while the input extremity thereof is rigidly affixed to the lower output surface of a connector plate 1164. The output extremity of a ram 1166 is rigidly affixed to the lower input surface of, and at the center of the connector plate 1164. The ram 1166 is pivotally mounted to the upper ends of the pair of parallel arms 1146. The arms 1146 are pivotally attached at lower ends to a pair of standoff shafts 1168, which are mounted on the base 1148. In this manner, the displacement of the ram 1166 will be largely longitudinal. The pair of standoff shafts 1168 extends laterally to the right to be fixedly attached into the lower left hand surface of the mount plate 1148. The mount plate 1148 is rigidly affixed at its lower right hand surface to a standoff mount 1150. The standoff mount 1150 is comprised of a cantilever plate 1170 and a standoff block 1172. The standoff block 1172 is rigidly affixed between the base 1148 and the cantilever plate 1170 to bring the follower wheels 1152 into proper lateral place with respect to the set of top belts 53. The output end of the cantilever plate 1170 is fixedly attached to and vertically adjustable upon the right hand surface of the belt plate 137. A pair of bolts 1174 passes through clear holes in a clamp plate 1176, through a long slot 1178 in the belt plate 137 and threadably mounts into the cantilever plate 1170.

A cable mount 1180 is rigidly affixed in cantilever form to the left and upper side of the base 1148 to provide mounting for a slide bolt 1182 and a flexible cable 1184. The slide bolt 1182 passes longitudinally in the output direction through a vertical slot in the cable mount 1180 and threadably and fixedly mounts into the upper right hand corner of the connector plate 1164. A stop nut 1183 is incorporated on the threaded shank of the slide bolt 1182 to compressively retain a spring (not shown) between the stop nut 1183 and the output surface of the cable mount 1180. The assembly is thereby urged in the output direction to assure that the three follower wheels 1152 remain in rolling contact with the input face of the forming slug of cartons 54. A push wire 1185 of the flexible cable 1184 is fixedly attached in the upper left hand corner of the connector plate 1164, the other end of which communicates with the control assembly 1141 of the microtorque control assembly 20 as is shown in FIG. 31. Since the pair of parallel arms 1146 oscillates near the top of its arc, the variation in vertical height of the ram 1166 is small, not adversely affecting the entry of the push wire 1185 into its flexible cable 1184. The three follower wheels 1152 are free to roll upon the input face of the forming slug of cartons 54, thereby signalling the control assembly 1141 as to the position thereof.

The push wire of the flexible cable 1184 is fixedly but pivotally attached to the upper end of a lever 1189 of the control assembly 1141. The lower end of lever 1189 is fixedly attached to the left end of a pivot rod 1191 that is in turn cantilever and pivotally mounted in a pair of standoff bearings 1193. Immediately to the right of the lever 1189 and fixedly attached to the pivot rod 1191 is a link lever 1195. The input end of an adjustable link 1197 is pivotally attached to the middle portion of the link lever 1195, while the output end thereof is pivotally attached to the upper end of a microtorque arm 1196 of a microtorque valve 1199. The lower end of the link lever 1195 is urged in counterclockwise rotation by a thrust spring 1198. The thrust spring 1198 therefore urges the push wire of the flexible cable 1184 in the output direction, which in turn pushes the three follower wheels 1152 against the forming slug of cartons 54.

Operation

Figure 32:
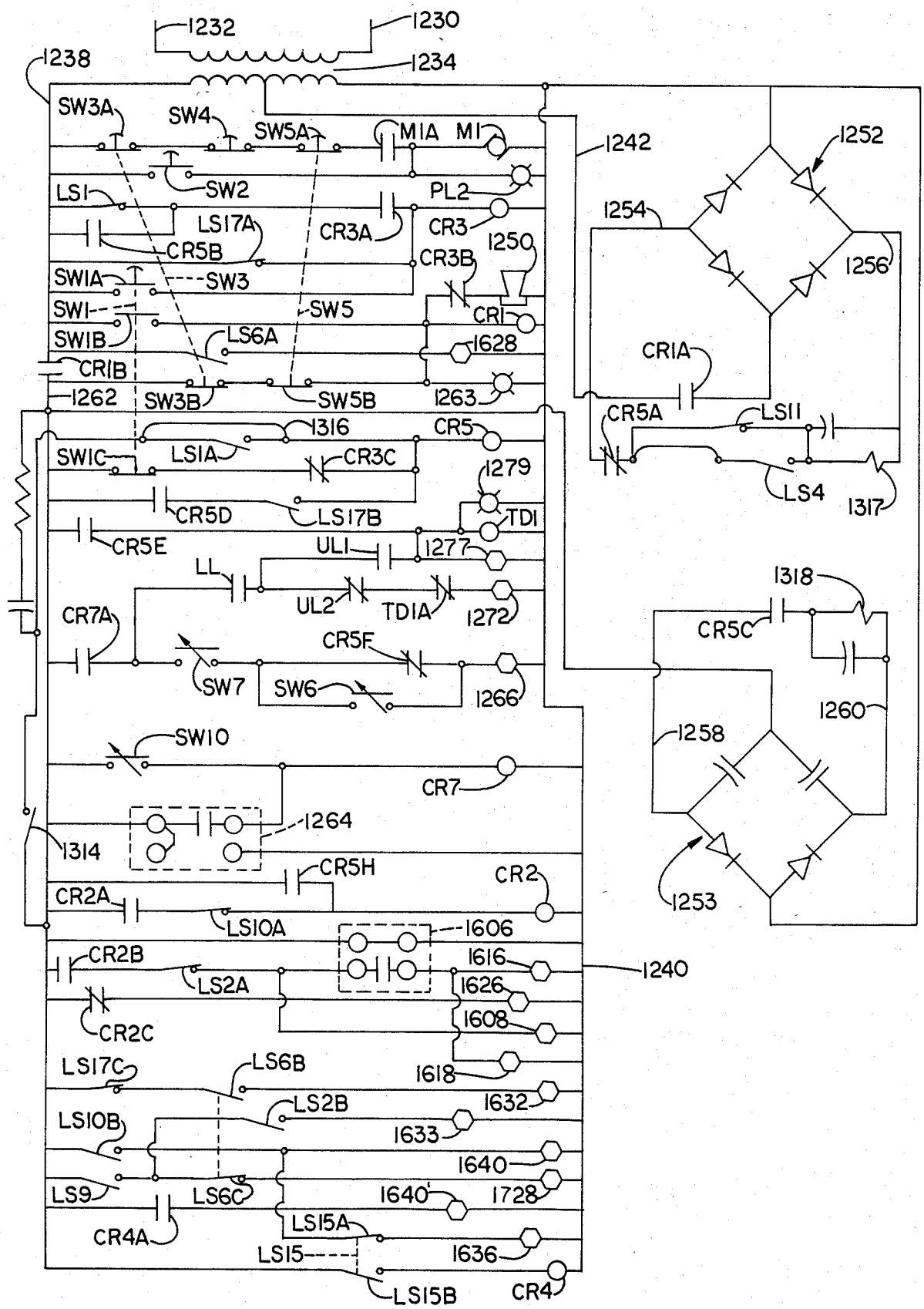
FIG. 32 is a schematic view of electrical connections of the machine.
Figure 33:
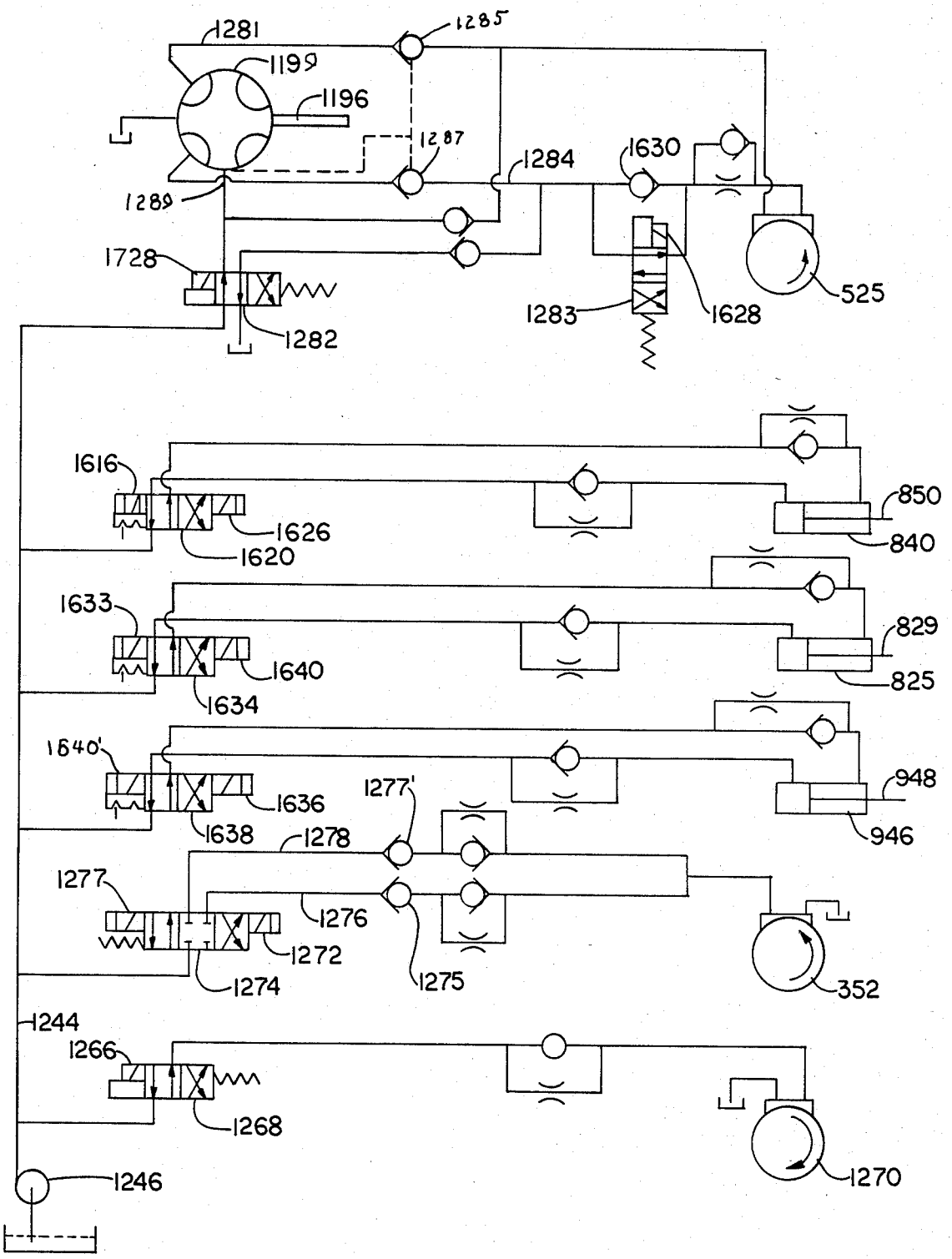
FIG. 33 is a schematic view of hydraulic connections of the machine.
Figure 34:
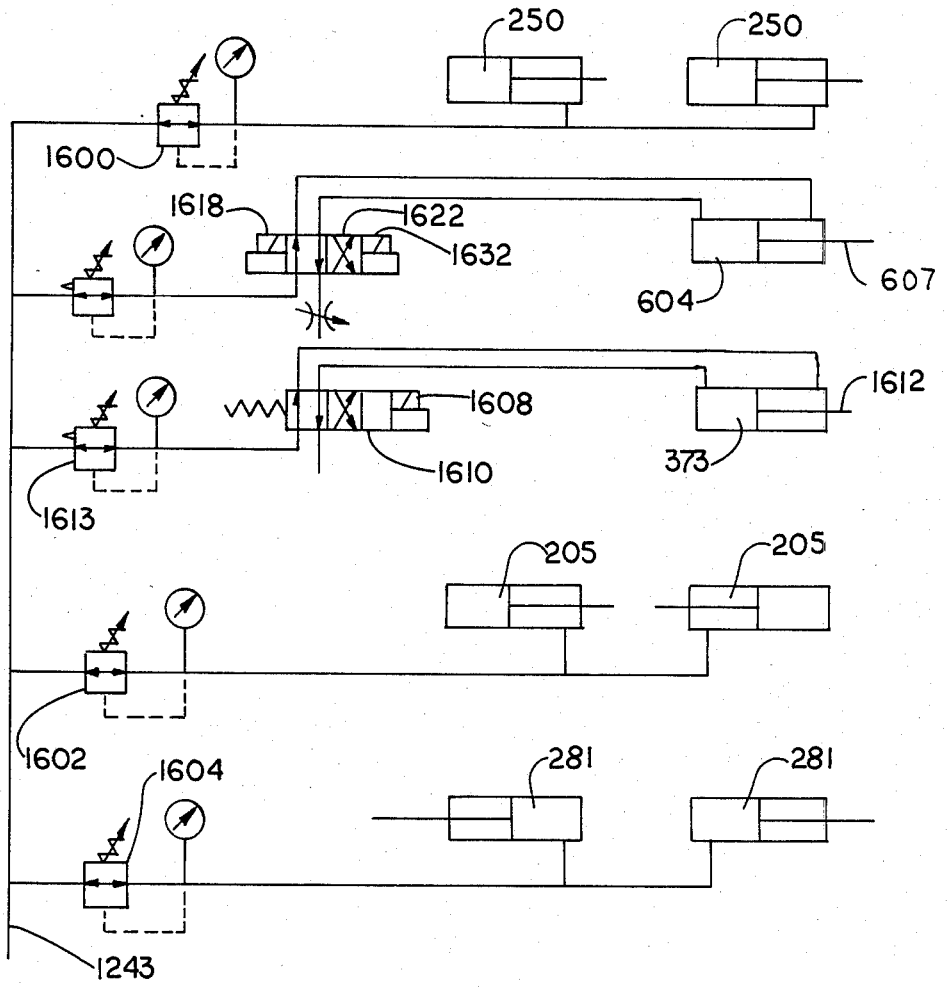
FIG. 34 is a schematic view of pneumatic connections of the machine.

Operation of the accumulator machine 10 will now be described in greater detail with reference to FIG. 32 which shows electrical connections, FIG. 33 which shows hydraulic connections, and FIG. 34 which shows pneumatic connections. Electric power is supplied by line leads 1230 and 1232 to a transformer 1234. The transformer 1234 supplies power to power leads 1238 and 1240 and to an auxiliary power lead 1242. Air under pressure is supplied through an air line 1243 (FIG. 34).

Hydraulic fluid is supplied to a pressure line 1244 (FIG. 33) by a pump 1246. The pump 1246 is driven by a motor M1. The motor M1 can be energized by closing of contacts of a push button switch SW2. When the motor M1 is energized, a lamp PL2 is illuminated and motor relay contacts M1A are closed. The motor M1 can be de-energized by action of any one of switches SW3, SW4 and SW5. Contacts SW3A and SW5A of the switches SW3 and SW5, respectively, and the contacts of the switch SW4 are in series with the motor relay contacts M1A and the motor M1. Opening of the contacts SW3A, the contacts SW5A, or the switch SW4 de-energizes the motor M1. Contacts SW3B and SW5B of the switches SW3 and SW5, respectively, are in series with a control relay CR1, and the control relay CR1 is de-energized when contacts of one of the switches SW3 and SW5 are opened.

Control circuits for the machine are set in operation by advancing a switch SW1 to its other position to close contacts SW1A and SW1B and to open contacts SW1C. Closing of the contacts SW1A energizes a control relay CR3 to close contacts CR3A and to open contacts CR3B and CR3C thereof. Closing of the contacts CR3A provides a hold-in circuit for the control relay CR3. Opening of the contacts CR3B disables an alarm horn 1250. Opening of the contacts CR3C disables the switch contacts SW1C.

Closing of the contacts SW1B energizes the control relay CR1 to close contacts CR1A and CR1B thereof and also causes illumination of a pilot light 1263 and sounding of the alarm horn 1250 if the contacts CR3B are closed. Closing of the contacts CR1A energizes clutch rectifier assembly 1252. The rectifier assembly 1252 supplies power to leads 1254 and 1256 to energize a clutch solenoid 1317 of the clutchbrake unit 50 (FIG. 7). Closing of the contacts CR1B connects a supply lead 1262 to the power lead 1238 and also energizes a brake rectifier assembly 1253 to supply power to leads 1258 and 1260.

A switch SW7 is positioned in its other position. Then, when an electric eye unit 1264 (not shown in detail) senses that cartons are being delivered to the input conveyor 32 (not shown in detail, FIG. 1), a control relay CR7 is energized to close contacts CR7A thereof and energize a solenoid 1266 of a valve 1268 to move the valve 1268 to its other position and cause advance of a hydraulic motor 1270, which causes advance of the input conveyor 32 (not shown in detail) to advance cartons to the input hopper 12 (FIG. 1). A switch SW10 is provided to maintain energizing of the control relay CR7 when desired, as during setup of the machine.

As the cartons 34 build up in the input hopper 12, a stack is formed which interrupts illumination of the second photocell assembly 62 (FIG. 5) to cause closing of second photocell contacts LL. Closing of the contacts LL energizes a solenoid 1272 of a valve 1274 to advance the valve 1274 to the left as shown in FIG. 33 to direct fluid under pressure along a ling 1276 to the hydraulic motor 352 (FIG. 7) to advance the motor 352 at a low speed and cause withdrawing of cartons 34 from the bottom of the stack in the input hopper 12 to be stacked on edge as shown in FIGS. 1, 6 and 8 with the cartons 34 supported on the belt 718 and above the table assembly 24 and backed up against the vertical rods 596 of the upper backstop assembly 449 and behind the follower wheels 1152 (FIG. 6). If the stack in the input hopper builds up to a size that interrupts illumination to the first photocell assembly 60, first photocell contacts UL1 close and first photocell contacts UL2 open. Opening of the contacts UL2 deenergizes the solenoid 1272. Closing of the contacts UL1 energizes a solenoid 1277 of the valve 1274 to advance the valve 1274 to the right and direct fluid under pressure along a line 1278 to advance the hydraulic motor 352 at high speed. Check valves 1275 and 1277' in the lines 1276 and 1278, respectively, prevent backflow in these lines. Closing of the contacts UL1 also energizes a relay TD1 and a pilot light 1279. Energizing of the relay TD1 opens instantaneous contacts TD1A thereof to disable the solenoid 1272.

As the cartons 34 are withdrawn from the stack in the input hopper 12, pressure is maintained on the cartons by the action of the cylinder 250 (FIG. 6), 205 (FIG. 15), and 281. Pressure on the cylinders 250, 205 and 281 is controlled by pressure regulator valves 1600, 1602 and 1604 (FIG. 34), respectively.

As the slug or stack builds up behind the follower wheels 1152 (FIGS. 6 and 19), the follower wheels 1152 are advanced to the right as shown in FIG. 6 to advance the push wire 1185 to the right causing turning of the microtorque arm 1196 (FIG. 31). Turning of the microtorque arm 1196 causes advance of the microtorque assembly to connect the pressure line 1244 to a lead 1281 through a valve 1282. The valve 1282 is in the position shown, and a valve 1283 is also in the position shown. When pressure fluid is supplied to the line 1281, the fluid causes advance of the hydraulic motor 525 (FIGS. 23 and 24) to cause retraction of the rods 596 to the left as shown in FIG. 23 as the slug of cartons builds up. Fluid is discharged from the motor 525 through a line 1284 to be discharged through the microtorque valve 1199. Pilot check valves 1285 and 1287 control flow in the lines 1281 and 1284, respectively, and are opened when there is pressure at a pressure port 1289.

As the slug of cartons 54 grows, contacts of the limit switch LS11 open. If the side pusher 30 (FIG. 12) is in proper retracted position, the limit switch LS4 is closed to provide a circuit in parallel with the limit switch LS11, and opening of the limit switch LS11 has no effect. However, if the side pusher 30 is improperly positioned, opening of the limit switch LS11 de-energizes the clutch solenoid 1317 to stop advance of cartons to the slug.

The slug of cartons increases in size until the counter assembly 16 records a full count. When the full count has been registered, a counter switch 1314 closes. If the limit switch LS1A is actuated to indicate that the slug is of satisfactory size, or if a jumper wire 1316 is in place, closing of the contacts of the counter switch 1314 causes energizing of a control relay CR5. Energizing of the control relay CR5 opens contacts CR5A, closes contacts CR5B, CR5C, CR5D and CR5E, opens contacts CR5F and closes contacts CR5H. Opening of the contacts CR5A de-energizes the clutch solenoid 1317 of the clutch-brake unit 50 (FIG. 7). Closing of contacts CR5B prevents de-energizing of the control relay CR3 when the limit switch LS-1 is opened. Closing of the contacts CR5C energizes a brake solenoid 1318 of the clutch-brake unit 50 so that the hopper belt 37 and the paired feed belts 14 are arrested. However, the paired inclined belts 18 continue to operate to discharge the last of the cartons which have been counted. Closing of the contacts CR5D operates a hold-in circuit for the control relay CR5 when the limit switch LS-17 is actuated. Closing of the contacts CR5E energizes the relay TD1 and the solenoid 1277. Opening of the contacts CR5F deenergizes the solenoid 1266 when a switch SW6 is in the position shown. Closing of the contacts CR5H energizes a control relay CR2.

If the counter switch 1314 should not be actuated before the limit switch LS-1 (FIG. 24) is actuated, opening of contacts of the limit switch LS-1 de-energizes the control relay CR3 to cause sounding of the alarm 1250 and to cause energizing of the control relay CR5.

Energizing of the control relay CR2 closes hold-in contacts CR2A and contacts CR2B and opens contacts CR2C. Closing of the contacts CR2B connects an electric eye unit 1606, not shown in detail, to the power lead 1262 and energizes a solenoid 1608. Energizing of the solenoid 1608 advances a valve 1610 to its other position to cause advance of a cylinder rod 1612 of the cylinder 373 and advance of the pusher wheels 351 (FIG. 6). A pressure regulator valve 1613 controls the pressure on the pusher wheels 351. The electric eye unit 1606 is provided with a fiber optic element 1614 which is arranged to project light on trailing portions of the cartons approaching the slug 54 and to register reflection therefrom. When the last carton of the slug 54 reaches the slug and there is no more reflection received by the fibre optic element 1614, the electric eye unit 1606 energizes solenoids 1616 and 1618 of valves 1620 and 1622, respectively. Energizing of the solenoid 1616 advances the valve 1620 to the position shown to cause extension of the cylinder rod 850 of the cylinder 840 (FIG. 8) and cause raising of the fingers 58. As the fingers 58 are raised, the ramps 838 of the three innermost fingers engage the pusher wheels 351, as shown in FIGS. 8 and 11. The valve 1620 is detented so that the fingers 58 remain in raised position until the detent is released and the valve 1620 is moved to its other position. Energizing of the solenoid 1618 advances the valve 1622 to the position shown to cause retraction of a cylinder rod 607 of the cylinder 604 and raising of the rods 596 (FIG. 23) from an exit position shown in FIG. 22 at 596A so that the slug is released to permit the first carton of the slug to engage the upper stop bar 882 and the lower stop bar 884. When the rods 596 are in fully raised position, the switch arm and roller assembly 676 of the limit switch LS-9 (FIG. 22) is raised by one of the holdback arms 586 to close the contacts of the limit switch LS-9. Opening of the relay contacts CR2C de-energizes a solenoid 1626 of the valve 1620.

Closing of the contacts of the limit switch LS-9 energizes a solenoid 1728 of the valve 1282 to cause advance of the valve 1282 to its other position and advance of the motor 525 in a direction to cause rapid return of the upper backstop assembly 449 to the right as shown in FIG. 23. When the limit switch LS-6 (FIG. 24) is actuated to indicate that the upper backstop assembly 449 has reached the limit of its movement, contacts LS-6A and LS-6B are closed and contacts LS6C are opened. Closing of the contacts LS-6A energizes a solenoid 1628 of the valve 1283 to advance the valve 1283 to its other position. When the valve 1283 is in its other position, a check valve 1630 prevents operation of the motor 525 in a direction to further retract the upper backstop assembly to the right as shown in FIG. 23. Closing of the contacts LS-6B energizes a solenoid 1632 of the valve 1622 to advance the valve 1622 to its other position so that the cylinder rod 607 of the cylinder 604 is advanced to cause lowering of the rods 596 (FIG. 23) at the home position shown at 596B in FIG. 22. Opening of the contacts LS-6C de-energizes the solenoid 1728 of the valve 1282 to permit the valve 1282 to return to the position shown in FIG. 33 ready for a new cycle.

When the fingers 58 are fully raised, the limit switch LS-2 (FIG. 8) is actuated to open contacts LS-2A and close contacts LS-2B. Opening of the contacts LS-2A de-energizes the electric eye unit 1606 to de-energize the solenoids 1616 and 1618, and also de-energizes the solenoid 1608. De-energizing of the solenoid 1608 permits the valve 1610 to advance to the position shown to cause retraction of the cylinder rod 1612 of the cylinder 373 so that the pusher wheels 351 are retracted to the right as shown in FIG. 6 into position for the next cycle of the machine. Closing of the contacts LS-2B energizes a solenoid 1633 of a detented valve 1634 to advance the valve 1634 to the position shown to cause advance of the cylinder rod 829 of the cylinder 825 and to cause advance of the extraction plate 823 to the left as shown in FIG. 8 and to advance the fingers 58 and the lower stop assembly 26 together with the slug of cartons to a discharge position, the fingers being shown at the discharge position at 58A (FIG. 23) and the upper stop bar being shown at the discharge position at 882A. As the extraction plate starts to move, the actuator of the limit switch LS-17 is released so that contacts LS-17A close, contacts LS-17B open and contacts LS-17C close. Closing of the contacts LS-17A prevents de-energizing of the control relay CR3. Opening of the contacts LS-17B de-energizes the control relay CR5 to cause energizing of the clutch solenoid 1317 and start of flow of articles to the next slug. When the extraction plate 823 reaches the discharge position, the limit switch LS-15 (FIG. 8) is actuated to open contacts LS-15A and close contacts LS-15B. Opening of the contacts LS-15A de-energizes a solenoid 1636 of a detented valve 1638. Closing of the contacts LS-15B energizes a control relay CR4.

Energizing of the control relay CR4 closes contacts CR4A thereof. Closing of the contacts CR4A energizes a solenoid 1640' of the valve 1638 to advance the valve 1638 to the position shown to advance the cylinder rod 948 of the cylinder 946 and cause advance of the side pusher assembly 30 to the right as shown in FIG. 12 to discharge the slug of cartons.

When the side pusher assembly 30 reaches the limit of its movement, the limit switch LS-10 is actuated to open contacts LS-10A and to close contacts LS-10B. Opening of the contacts LS-10A de-energizes the control relay CR2. When the control relay CR2 is de-energized, the solenoid 1626 of the valve 1620 is energized to advance the valve 1620 to its other position to cause retraction of the cylinder rod 850 of the cylinder 840 and lowering of the fingers 58 (FIG. 8).

Closing of the contacts LS-10B energizes a solenoid 1640 of the valve 1634. When the solenoid 1640 is energized, the valve 1634 is advanced to its other position, and the cylinder rod 829 of the cylinder 825 is withdrawn to return the extraction plate 823 and associated assemblies to the right as shown in FIG. 8. When the extraction plate 823 and associated assemblies start to the right, the limit switch LS-15 is released, and the contacts LS-15A close to energize the solenoid 1636. Energizing of the solenoid 1636 advances the valve 1638 to its other position to cause retraction of the cylinder rod 948 of the cylinder 946 to cause return of the pusher assembly 30 as shown in FIG. 12.

When the pusher assembly 30 is in returned position, the limit switch LS-4 is actuated to close the contacts thereof to provide a circuit in parallel to the limit switch LS-11, so that the flow of cartons is not stopped when the limit switch LS-11 is actuated. When the extraction plate 823 and associated assemblies have been returned to the right as shown in FIG. 8, the limit switch LS-17 is actuated to open contacts LS-17A, close contacts LS-17B and open contacts LS-17C. Opening of the contacts LS-17A permits de-energizing of the control relay CR3. Closing of the contacts LS-17B makes it possible to actuate a hold-in circuit for the control relay CR5. Opening of the contacts LS-17C de-energizes the solenoid 1632.

The machine for accumulating flat articles in a stack which has been described above is subject to structural modification without departing from the spirit and scope of the appended claims.

Having described our invention, what we claim as new and desire to secure by Letters Patent is:

1. A machine for forming a slug of edgewise supported flat articles which comprises a table, paired conveyor belt means advancing the articles in shingle fashion past an edge of the table, one of the belt means having a portion parallel to and at substantially the level of the table for rapidly advancing lower edges of the articles away from the other of the belt means and onto the table, an upper backstop means supporting the articles on the table and on said belt portion, means urging the articles toward the upper backstop means to form the slug, means for advancing the upper backstop means away from said edge of the table as the slug of articles forms on the table, means for arresting advance of articles to the slug when the slug reaches a predetermined size, an auxiliary backstop means, means for transferring control of the slug from the upper backstop means to the auxiliary backstop means, upright finger means advanceable into engagement with a last article in the slug, and means for advancing the finger means and the auxiliary backstop means in unison to advance the slug to a discharge station.

2. A machine as in claim 1 which includes means for advancing the slug sidewise of the fingers and of the backstop means when the slug is at the discharge station to discharge the slug.

3. A machine as in claim 1 in which the articles are advanced upwardly by the paired conveyor belt means from below the level of the table to a position extending upwardly of the level of the table and said one of the belt means turns from an upward direction to a horizontal direction at the portion parallel to and at substantially the level of the table.

4. A machine as in claim 3 in which the machine includes roller means engageable with the last article of the slug to advance said last article onto the portion of said one of the belt means parallel to and at substantially the level of the table, means for raising the finger means, the finger means having ramp means engageable with the roller means to urge the roller means away from the slug when the fingers are raised and means for retracting the roller means when articles other than the last article approach the slug.

5. A machine as in claim 1 in which there is means for returning the upper backstop means to an initial article supporting position when control of the slug has been transferred from the upper backstop means to the auxiliary backstop means and for advancing further articles toward the upper backstop means to form a second slug of articles while the first slug is being advanced.

6. A machine for forming a slug of edgewise supported flat articles which comprises a table, paired conveyor belt means advancing the articles in shingle fashion past an edge of the table, one of the belt means having a portion parallel to and at substantially the level of the table for rapidly advancing lower edges of the articles away from the other of the belt means and onto the table, an upper backstop means supporting the articles on the table and on said belt portion, means urging the articles toward the upper backstop means to form the slug, means for advancing the upper backstop means away from said edge of the table as the slug of articles forms on the table, means for arresting advance of articles to the slug when the slug reaches a predetermined size, an auxiliary backstop means, means for transferring control of the slug from the upper backstop means to the auxiliary backstop means, upright finger means advanceable into engagement with a last article in the slug, roller means engageable with the last article of the slug to advance said last article onto the portion of said one of the belt means parallel to and at substantially the level of the table, means for withdrawing the roller means when articles other than the last article approach the slug, and means for advancing the finger means and the auxiliary backstop means in unison to advance the slug to a discharge station.

* * * * *